US006964231B1

(12) United States Patent
Robinson et al.

(10) Patent No.: US 6,964,231 B1
(45) Date of Patent: Nov. 15, 2005

(54) MINIATURE MEMS-BASED ELECTRO-MECHANICAL SAFETY AND ARMING DEVICE

(75) Inventors: Charles H. Robinson, Silver Spring, MD (US); Robert H. Wood, Laurel, MD (US); Thinh Q. Hoang, Richmond, VA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 202 days.

(21) Appl. No.: 10/248,972

(22) Filed: Mar. 6, 2003

Related U.S. Application Data

(60) Provisional application No. 60/319,727, filed on Nov. 25, 2002.

(51) Int. Cl.[7] ..... F42C 15/26
(52) U.S. Cl. ..... 102/235; 102/231; 102/233
(58) Field of Search ..... 102/223, 221, 102/233, 242, 249, 231, 235

(56) References Cited

U.S. PATENT DOCUMENTS 4,815,381 A * 3/1989 Bullard ..... 102/247
5,705,767 A * 1/1998 Robinson ..... 102/231
6,167,809 B1 * 1/2001 Robinson et al. ..... 102/235
6,308,631 B1 * 10/2001 Smith et al. ..... 102/254
6,321,654 B1 * 11/2001 Robinson ..... 102/251
6,374,739 B1 * 4/2002 Smith et al. ..... 102/221
6,431,071 B1 * 8/2002 Hodge et al. ..... 102/254
6,439,119 B1 * 8/2002 Smith et al. ..... 102/221
6,568,329 B1 * 5/2003 Robinson ..... 102/231

* cited by examiner

*Primary Examiner*—Harvey E. Behrend
*Assistant Examiner*—Bret Hayes
(74) *Attorney, Agent, or Firm*—John F. Moran

(57) ABSTRACT

A MEMS type safety and arming device includes a substrate; a frame disposed on the substrate; a setback slider disposed in the frame, the setback slider moving linearly in response to a setback acceleration; an arming slider disposed in the frame, the arming slider moving linearly in an arming direction perpendicular to the direction of the setback acceleration and in response to spin; a setback lock lever disposed in the frame, the setback lock lever engaging the arming slider to prevent linear motion of the arming slider until the setback slider contacts and moves the setback lock lever; and a command lock rocker disposed in the frame, the command lock rocker engaging the arming slider to prevent full arming motion of the arming slider until after the command lock rocker is actuated.

34 Claims, 22 Drawing Sheets

SECTION A-A

SECTION B-B

SECTION F-F

SECTION C-C

SECTION D-D

SECTION E-E

SECTION G-G

SECTION H-H

MINIATURE MEMS-BASED ELECTRO-MECHANICAL SAFETY AND ARMING DEVICE

CROSS REFERENCE TO RELATED APPLICATIONS

This application claims the benefit of priority of U.S. provisional patent application Ser. No. 60/319,727 filed on Nov. 25, 2002, which application is expressly incorporated by reference.

FEDERAL RESEARCH STATEMENT

[The inventions described herein may be manufactured, used and licensed by or for the U.S. Government for U.S. Government purposes.]

BACKGROUND OF INVENTION

The invention relates to an ultra-miniature electro-mechanical safety and arming (S&A) device for gun-launched munitions. The invention incorporates mechanical logic for reliability and safety. The invention is typically fabricated using micro-electromechanical systems (MEMS) based technology and processes, but can also be fabricated or assembled using offshoot technologies such as plating, molding, plastic injection, ceramic casting, etc. An important application of the invention is in munition fuze safety and arming for gun-launched munitions, wherein launch (setback) acceleration and spin-induced centrifugal acceleration are sequentially detected, thresholded, and utilized to effectuate mechanical arming of a firetrain, and further wherein spurious and unacceptable inertial inputs such as transportation and handling vibration and mechanical shocks are rejected and do not effectuate mechanical arming of a firetrain.

To assure safety in the transportation, handling, and deployment of gun-fired and other explosive munitions, munition-fuze safety standards such as MIL-STD-1316 require that two unique and independent aspects of the launch environment must be detected in the weapon fuze system before the weapon can be enabled to arm. Examples of the aspects of the launch environment that are sensed electronically or mechanically in existing systems are: setback acceleration, rifling-induced spin, gun- or launch-tube exit, airflow, and flight apex. Munition fuzes also typically perform targeting functions, which can include electromagnetic or electrostatic target detection, range estimation, target impact detection, grazing impact detection, or timed delay.

Many of the above sensing functions can be performed either electronically or mechanically, as several examples illustrate. First, the velocity change due to setback acceleration during tube launch can be quantified using an accelerometer and an integrating circuit, or by using a mechanical integrator (See, e.g., U.S. Pat. No. 5,705,767). Second, the occurrence of setback acceleration or spin acceleration can be detected with a simple mechanical inertial switch such as a reed switch, or with a calibrated accelerometer and a threshold detection circuit. Third, target impact or grazing impact may be detected using a crush switch, an accelerometer with a threshold circuit, or a mechanical inertial switch. The best method to use for any of these functions in a given munition application depends on characteristics of the weapon system such as limitations of size, onboard system power, desired configuration, or on factors such as affordable cost, material selection and compatibility, requirements for safety, or requirements for reliability.

In some fuzing applications for small- and medium-caliber fuzes, several of the above requirements become especially important. For example, a mechanical S&A for a 20-mm bursting projectile should be inexpensive (on the order of several dollars when manufactured in large quantities), should be extremely small to allow room for payload (lethality), should preferably require no pre-launch power since the battery typically does not activate until launch, and should have an initiation circuit that operates from a low-voltage battery. The present invention strives to meet all of these requirements. By contrast, an alternative technology is that of electronic safety and arming (ESA), which is often implemented in missiles. However, an ESA is currently not feasible for medium-and small-caliber artillery because of the relatively large cost and volume associated with components such as a slapper detonator and its high-voltage fireset, low-inductance fire circuit, a micro-controller or ASIC, a battery, and the need for one or more environment sensors as inputs to fuze logic.

In the munition fuzing industry the need for 'smarter' or more effective weapons often requires additional space within the weapon for signal and guidance electronics, power management, and sensors, while the need for greater lethality or payload makes simultaneous demands on volume. One solution is in the further miniaturization of existing fuze functions, particularly in the area of mechanical safety and arming. There is also a need to reduce the cost of existing weapon functions to make munition systems more affordable. This need is felt acutely in small- and medium-caliber weapons because of the large numbers needed to be produced to support a fielded system.

With current trends, the domestic precision small-parts manufacturing industry involved in producing current-day 'watchworks'-based mechanical S&As is diminishing or moving overseas, so that an alternative and economical domestic source is needed for future fuze components production. The present invention has the advantage that its manufacture draws on fabrication principles and techniques from the installed domestic infrastructure of the microelectronics industry and the partially-installed and rapidly growing MEMS fabrication and high-volume replication infrastructure.

The old methods of design, prototyping, and production involve S&A designs that are not optimal for integration with small- and medium-caliber munition fuzes. The old methods are too bulky, too expensive to manufacture, do not achieve a sufficient amount of safety, are limited in reliability, or are difficult or unsuitable to integrate with current sophisticated fuze technology that incorporates advanced target proximity detection, sensor integration, guidance, and global positioning system data integration. The old methods are similarly not optimal for large-caliber fuze applications, and for many of the same reasons.

The designs and technology incorporated in the present invention are highly desirable to accommodate the aforementioned competing demands for volume in ordnance that must contain increasingly sophisticated fuzing and guidance circuits, as well as larger warheads and payloads. The state of the art as represented by prior-art patents is inadequate for applications requiring extreme miniaturization, low cost, readiness for electronic integration, and the other advantages stated.

In general, prior-art mechanical S&As that are fabricated using conventional (non-MEMS-based) manufacturing processes are too large; are too expensive; use too many parts, often of dissimilar materials, that must be assembled; involve a domestic precision small-parts manufacturing industry that is shrinking and moving overseas;

involve tight clearances and dimensional tolerances that are expensive to fabricate and assure using conventional machining operations; involve materials and parts that require lubrication to reduce working friction, however, such lubricant can, over time, lose its lubricity, foul other parts, or become viscous; do not take advantage of recent micro-scale fabrication technologies that use principles and processes well known and widely utilized in the micro-electronic fabrication industry, e.g., optical masking directly from CAD layouts, optical exposure, chemical developing and rinsing, material plating or deposition, etc., to create three-dimensional mechanical structures.

Some prior devices are shown in U.S. Pat. No. 6,167,809 issued on Jan. 2, 2001 to Robinson et al. and entitled "Ultra-Miniature Monolithic, Mechanical Safety-and-Arming Device for Projected Munitions" U.S. Pat. No. 6,308,631 to Smith et al.; U.S. Pat. No. 5,824,910 to Last et al.; U.S. Pat. No. 6,173,650 to Garvick et al.; U.S. Pat. No. 5,693,906 issued on Dec. 2, 1997 to Van Sloun and entitled "Electro-Mechanical Safety and Arming Device"; and U.S. Pat. No. 5,275,107 issued on Jan. 4, 1994 to Weber et al. and entitled "Gun-Launched Non-Spinning Safety and Arming Mechanism."

SUMMARY OF INVENTION

It is a primary object of the invention to function as the mechanical S&A for a 20-mm high-explosive air-burst (HEAB) gun-launched grenade. In this application, the invention reduces cost and volume significantly over the baseline system which is based on conventional fabrication techniques, i.e., not MEMS-based. Significantly, the present invention also has the potential for widespread application to other systems in the fuzing industry.

The present invention meets the need for an extremely miniature, low cost, electro-mechanical safety and arming device for small- and medium-caliber gun-launched and rifling-spun munition fuzes. It further meets the need for a safety and arming device incorporating a high degree of user safety and functional reliability. User safety means, among other things, the prevention of mechanical arming under all conditions except when the correct launch stimuli are received by the device as a result of gun launch. Reliability is the relative certainty that the device will perform its function when the correct launch stimuli are received by the device. The invention further meets the need for a miniature, low cost, electro-mechanical safety and arming device for small- and medium-caliber gun-launched and rifling-spun munition fuzes that can readily be mass-produced using advanced MEMS-based replication, assembly, explosive loading, and packing techniques for affordability.

As compared to the prior art, the present invention reduces volume significantly over the non-MEMS S&A baseline; reduces cost over the non-MEMS S&A baseline; incorporates improved safety logic, with more locks and checks controlling the position of the arming slider than previous designs. The present invention also incorporates better design features, such as: 1) The working parts may, if desired, be fabricated all be of the same material, eliminating material incompatibility issues; 2) No lubrication is needed for MEMS assemblies, eliminating problems associated with aging lubricants found in prior-art mechanical S&As; 3) Fabrication methods based on semiconductor-industry mask, etch and release type technology implement more sophisticated mechanical safety logic and better fabrication and assembly methods.

For example, parts can be made of ceramic, plastic, or metal in separate optimized processes, and brought together in a machine-vision controlled micro-assembly process that includes: 1) wafer-scale fabrication and assembly; 2) wafer-scale explosive slurry loading of the firetrain elements; 3) machine-vision inspection; 3) rapid implementation of design changes because the parts fabrication template comes directly from a CAD file via the optical fabrication mask. For example, to stiffen one of the slider springs to accommodate a new launch velocity would only take about 3 weeks to re-design the spring on the computer, develop the new optical mask, expose, develop and plate substrate "masters", and begin high-volume replication of the new parts.

Thus, the present invention provides the safety and arming function with a maximum of simplicity and safety and a minimum of cost, size, and power requirements.

The invention will be better understood, and further objects, features, and advantages thereof will become more apparent from the following description of the preferred embodiments, taken in conjunction with the accompanying drawings.

BRIEF DESCRIPTION OF DRAWINGS

In the drawings, which are not necessarily to scale, like or corresponding parts are denoted by like or corresponding reference numerals.

DETAILED DESCRIPTION

The present invention is an ultra-miniature electro-mechanical safety and arming (S&A) device for gun-launched munitions. The device is fabricated and assembled using generally wafer-based micro-machining techniques, known in the United States as micro-electro-mechanical systems (MEMS) technology and elsewhere as micro-systems technology (MST). The invention incorporates advancements in design, safety architecture, fabrication methodology, and miniaturization over earlier U.S. Pat. Nos. 6,167,809, 6,321,654 and 5,705,767.

Figure 1A:
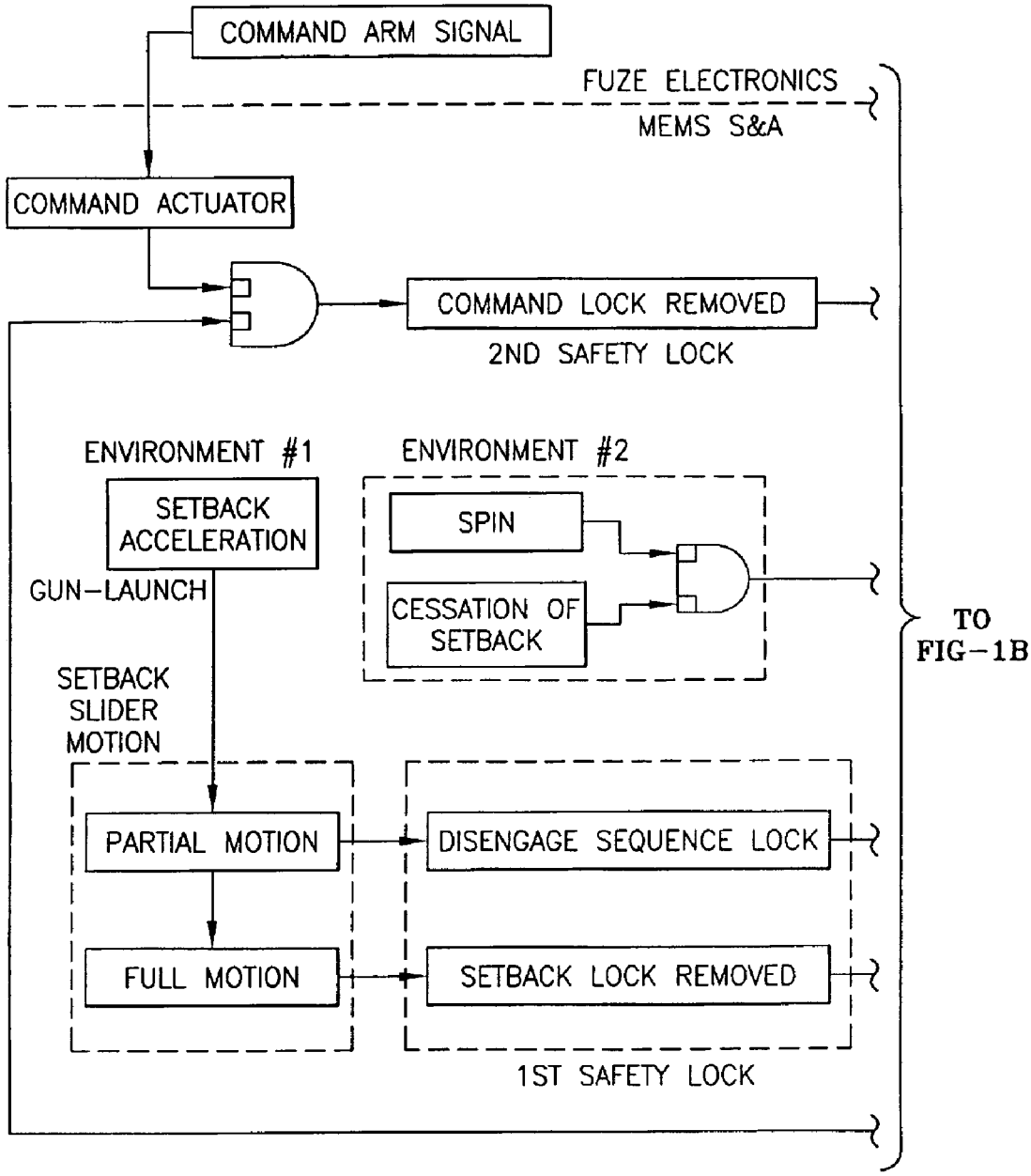
FIGS. 1A and 1B are a block diagram of the mechanical logic and fuze interface implemented by the invention.
Figure 1B:
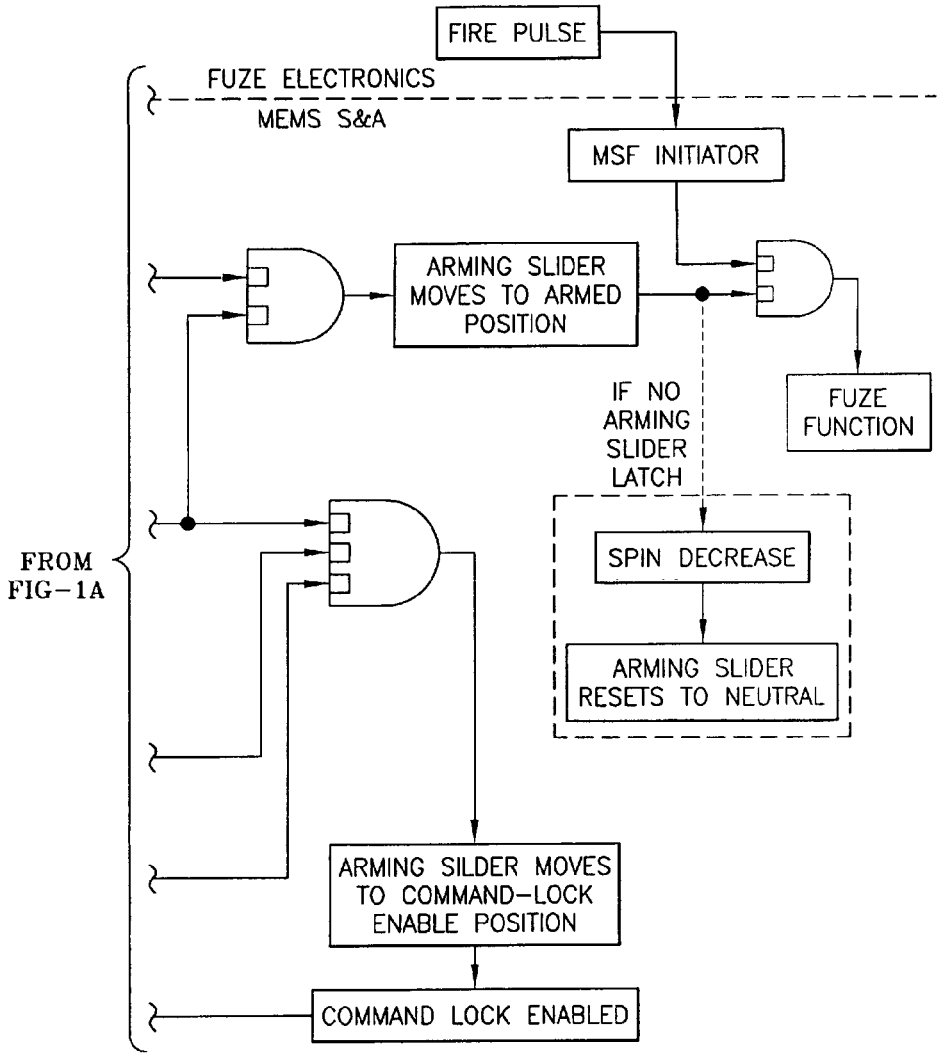

The safety of the inventive safety and arming device derives from the highly selective mechanical logic. FIGS. 1A and 1B show a block diagram of the mechanical logic and fuze interface implemented by the invention. Environmental stimuli of unique direction, threshold, sequence, and duration are necessary to effectuate the arming sequence in the mechanical logic. Environmental inputs that do not match the launch sequence result in one of two outcomes: a) The mechanical logic elements may partially respond to the inputs and then reset to their original "safe" (unarmed) position, or b) The mechanical logic elements may partially respond to the inputs and due to the out-of-sequence or improper nature of the inputs the mechanical elements may finish in a "failed safe" condition.

Figure 2A:
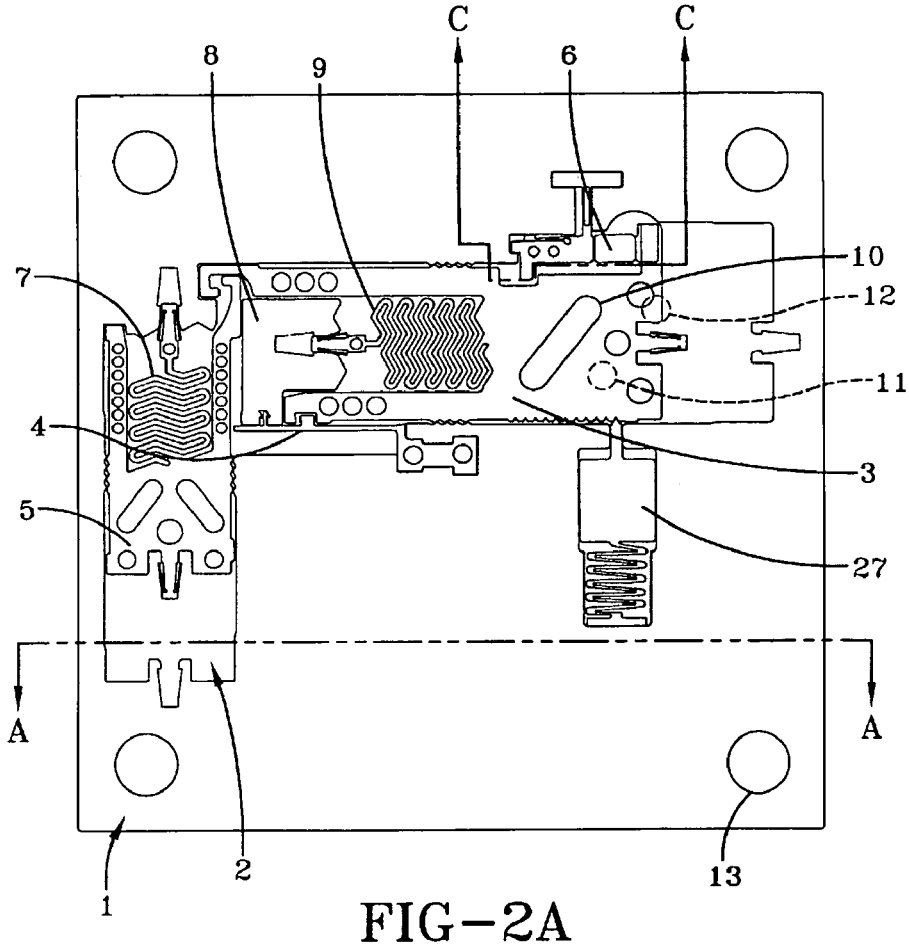
FIG. 2A is a plan view of the partially assembled MEMS device layer of a first embodiment of the invention.
Figure 2B:
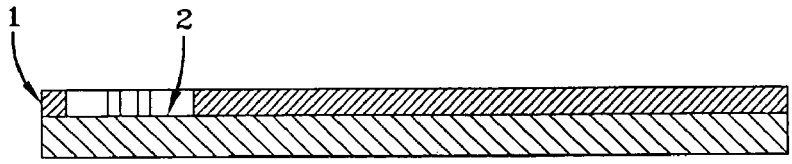
FIG. 2B is a sectional view along the line A—A of FIG. 2A.

FIG. 2A is a plan view of the partially assembled MEMS device of a one embodiment of the invention. FIG. 2B is a sectional view along the line A—A of FIG. 2A. The partially-assembled device comprises a device-layer frame 1 affixed to a planar substrate 2. There is a pattern of cutout slots or openings in the frame 1 in which the working parts of the device are juxtaposed interworkingly as follows: the position of the arming slider 3 is controlled and determined by the disposition of the setback slider 5, the setback lock lever 4, the command lock rocker 6, the biased reset spring assembly 9, and the presence or absence of an inertially-induced force along the axis of the arming slider 3 in the right-hand direction. Detent slider assembly 27 is omitted from the assembly during normal operation of the invention, as will be explained below.

Description of the Arming Slider 3 and Spring Assembly 9

Figure 3A:
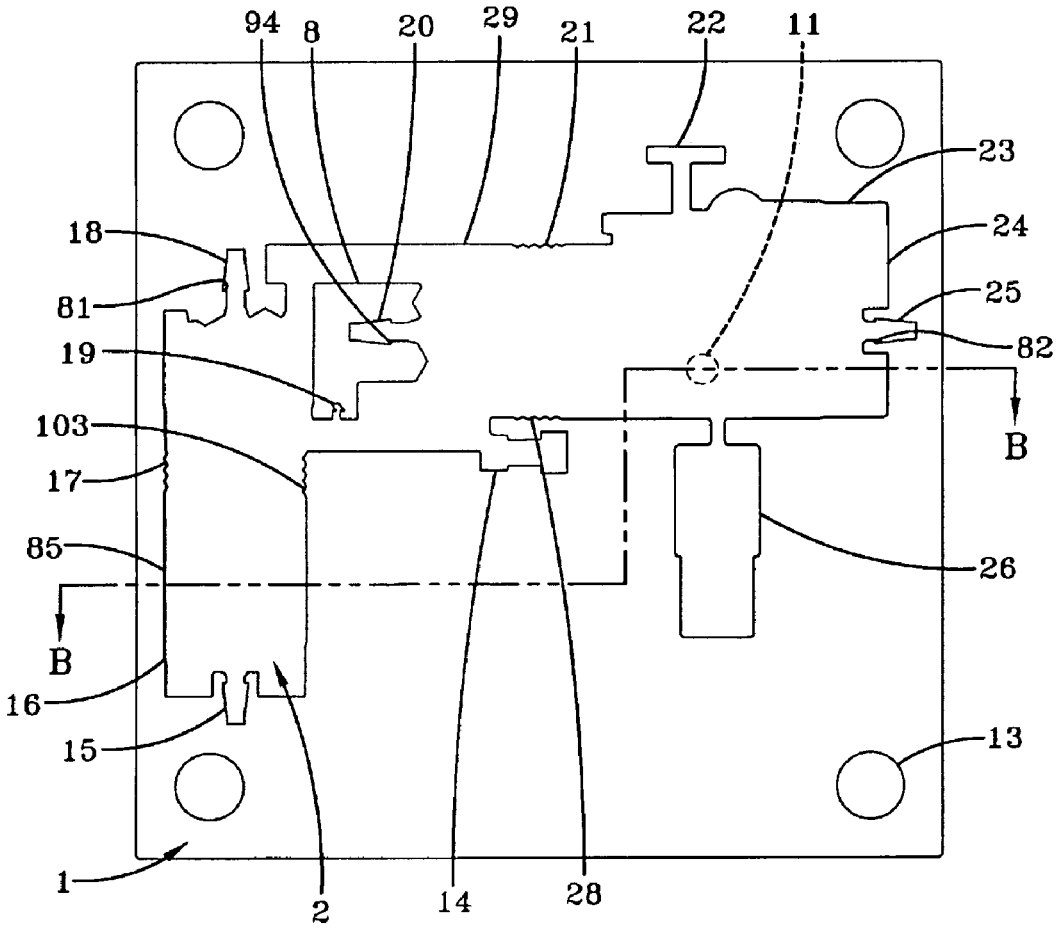
FIG. 3A is a plan view of the frame 1 of the device of FIG. 2A.
Figure 3B:
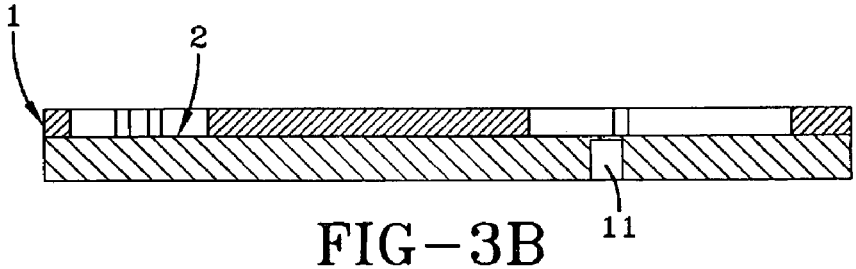
FIG. 3B is a sectional view along the line B—B of FIG. 3A.
Figure 4:
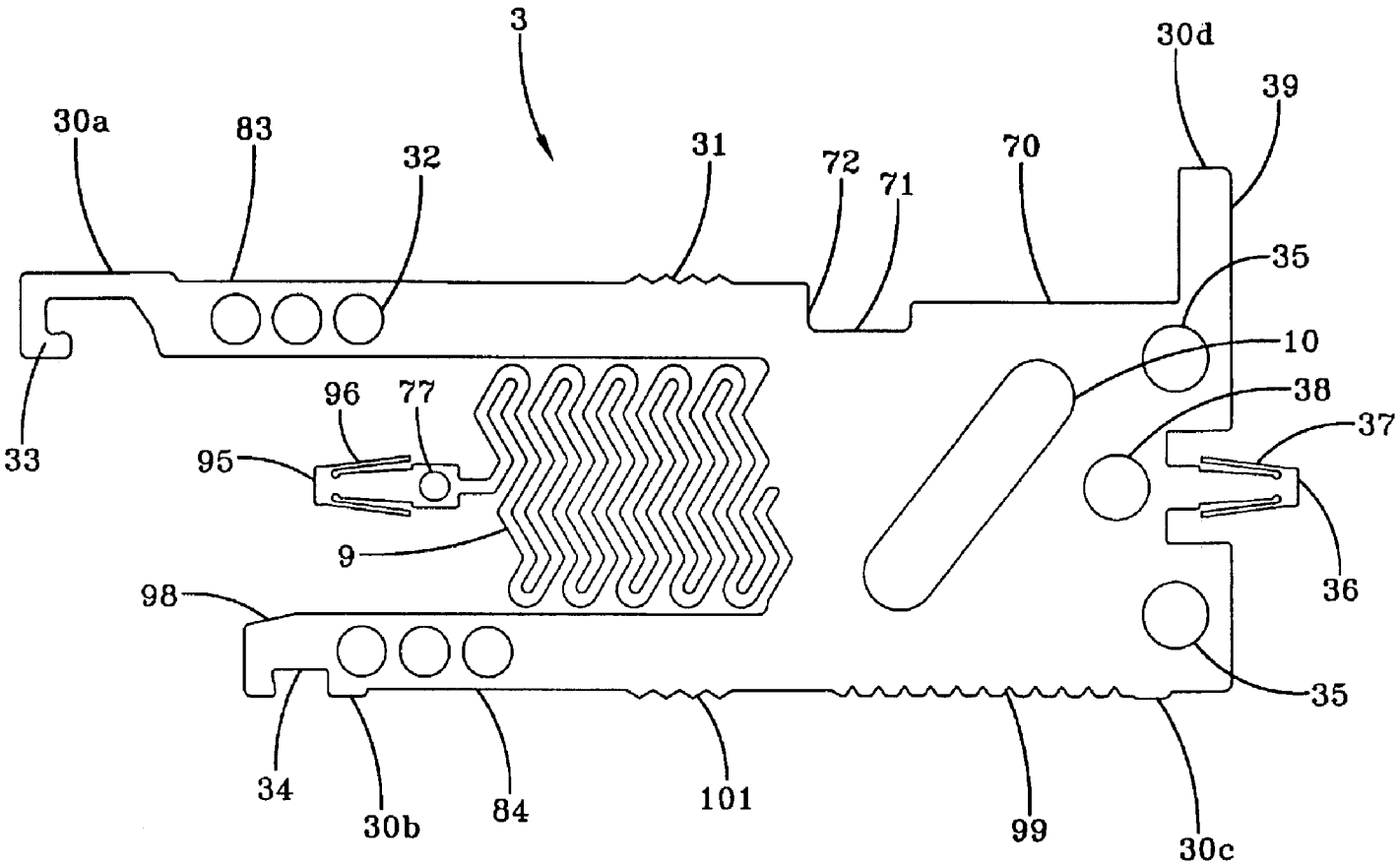
FIG. 4 is a plan view of the arming slider 3 of FIG. 2A.

FIG. 3A is a plan view of the frame 1 of the device of FIG. 2A. FIG. 3B is a sectional view along the line B—B of FIG. 3A. FIG. 4 shows a plan view of the arming slider 3 of FIG. 2A. The arming slider 3 shown in plan view in FIG. 4 comprises a mass (the arming slider body itself), an integral spring 9 with spring bias latch head 95, zig-zag racks 31 and 101, an end-of travel latch head 36, gripper holes 35 (pair), a plurality of lightening holes 32 to manage the center of gravity (c.g.) of the slider mass, an extended lower arm 84 with a catch 34 at the end of it, and an extended upper arm 83 with an interlock hook 33 at the end of it. There are guide bumps 30*a,b,c,d* at the corners of the slider 3 and arms 83, 84 that guide the slider 3 in the frame arming slider travel slot 29 (FIG. 3A). Extended upper arm 83 has a guide bump 30*a* that is longer than the other guide bumps.

Arming slider assembly 3 also includes a transfer charge pocket 10; command slider interface features 39, 70, 71, 72; interlock hook 33 that engages a catch 58 on the setback slider 5; and spaced detents 99 that are used for test purposes. The spring 9 is nested in a pocket between the arms 83 and 84 and is guided by them. The lower arm 84 has a tapered portion 98 which assists the spring 9 in feeding back easily into the pocket after a temporary extension of the spring. The slider 3 is designed with extended arms 83 and 84 to, in part, increase its effective length in the slot 29 to avoid mechanical jamming or cocking of the slider 3 in the slot 29. The bias spring 9 is designed in a wavy or serpentine profile to improve the ability of the plastic mold "fingers" that define the spring 9 to keep their shape and support themselves during the plating, pressing or molding operation used to create the spring 9. To omit the wavy profile would mean the mold for the spring "coils" would essentially be like long, unsupported "fences."

The number of repetitive zig-zag motions of the arming slider 3 caused by zig-zag racks 31, 101 operating in coordinated zig-zag tracks 21, 28 yields a programmed delay for a given acceleration input along the axis of the slider 3. Once the zig-zag racks 31, 101 clear the track zig-zag features 21, 28, the slider 3 can go into a "free fall" mode, picking up speed under a continued axial acceleration due to spin, to impact the stop 24 (FIG. 3A) and insert and lock the arming slider latch head 36 into the arming slider latch socket 25. The latch barb pair 37 "clicks" into a latched position with the ends of the barbs resting on arming slider socket catch 82 on each side, to capture the slider 3. The arming slider track 29 is designed so that there is an adequate side-to-side clearance between the slider 3 and the track 29 to allow the zig-zag motion without binding.

At each corner of the slider 3 is a guide bump 30*a*, 30*b*, 30*c*, 30*d* used to position the slider correctly in the track 29 to avoid mechanical jamming. There is a taper 23 in the far-right section of the track 29 to force the slider 3 into a centered position so that the latch head 36 can enter correctly into the latch socket 25. When the slider 3 is assembled into the track 29 during assembly, bias spring 9 must be extended to insert spring latch head 95 into spring head socket 20 to tension or pre-bias the spring 9. Gripper hole 77 may be used for this purpose. The spring latch head 95 can be drawn into the latch socket 20 until latch barb pair 96 "clicks" into a latched position with the ends of the barbs 96 resting on catch 94, on each side. This has the effect of creating a bias tension in the spring 9.

Figure 12:
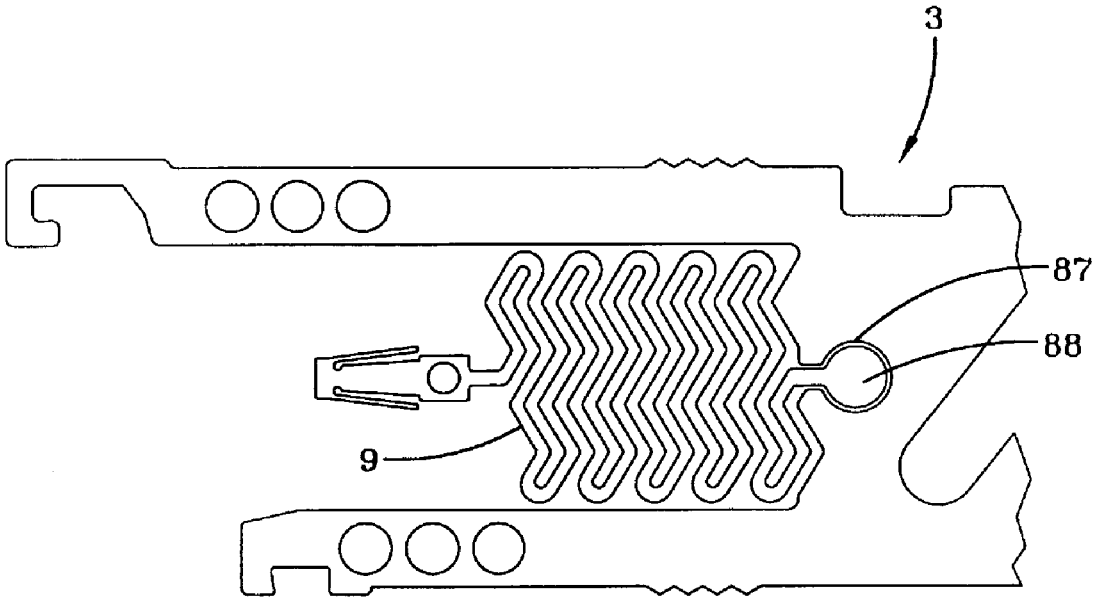
FIG. 12 shows a plan view of another embodiment of an arming slider 3 having a spring insertion plug and socket for attaching a separately made spring to the slider 3.

FIG. 12 shows a plan view of another embodiment of an arming slider 3 having a spring insertion plug and socket for attaching a separately made spring 9 to the slider 3. In the alternative embodiment of FIG. 12, the arming slider 3 and its biasing spring 9, rather than being an integral whole, are made separately and are assembled together by including an insertion plug 88 at the rightmost end of the spring 9 that plugs into a matching socket 87 in the arming slider 3. This allows the spring 9 to be optimized in one MEMS process while the slider 3 is optimized in a different and perhaps less expensive process.

Description of the Setback Slider 5

Figure 5:
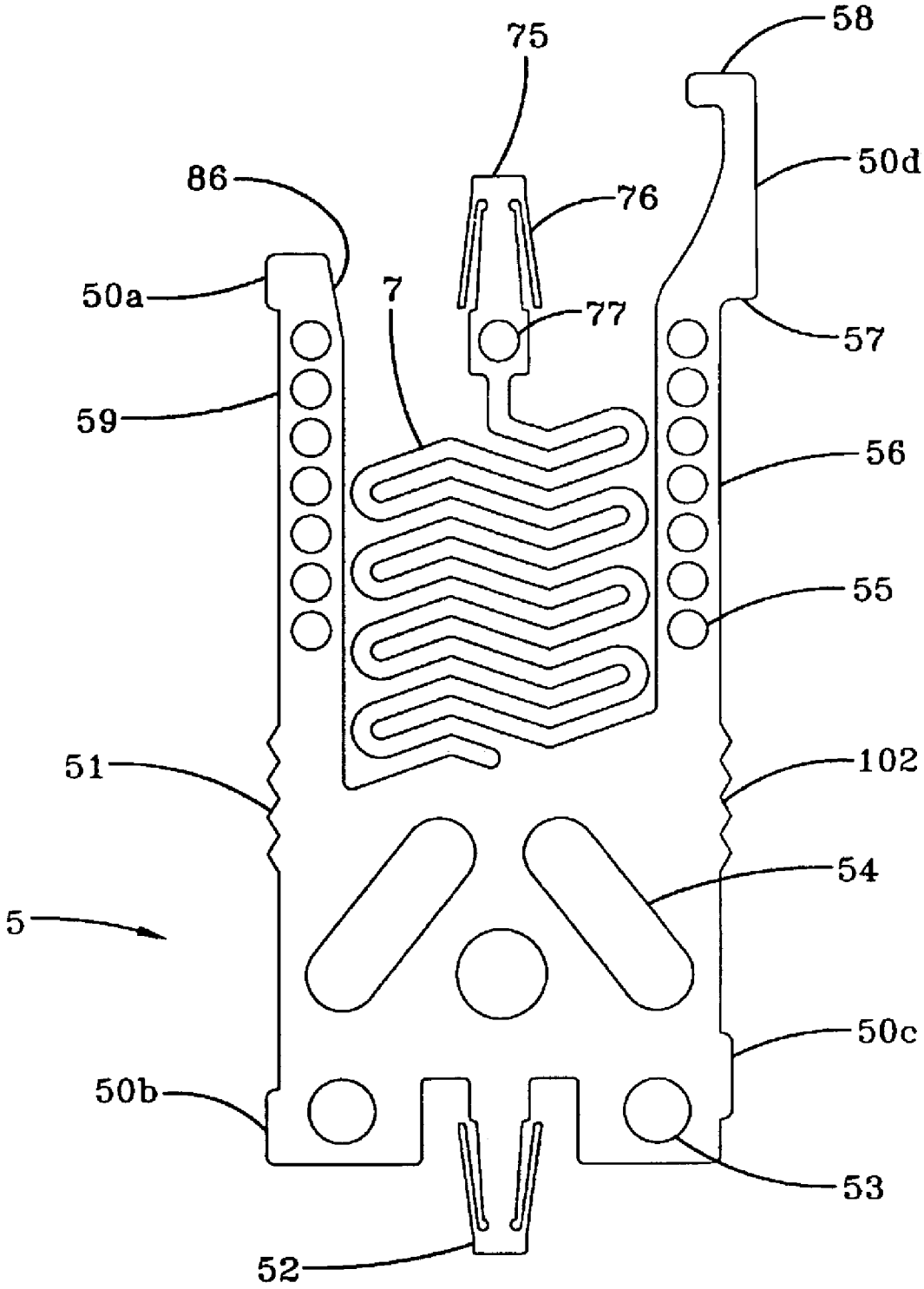
FIG. 5 is a plan view of one embodiment of a setback slider.

FIG. 5 shows a plan view of one embodiment of a setback slider 5. The setback slider 5 comprises a mass (the setback slider body itself), an integral spring 7 with latch head 75, zig-zag racks 51, 102, an end-of travel latch head 52, gripper holes 53 (pair), lightening slots 54 and a plurality of holes 55 to manage the c.g. of the mass, an extended left arm 59, an extended right arm 56 and catch 58 at the upper end of the arm 56. There are guide bumps 50*a,b,c,d* at the two lower corners of the slider 5 and the two upper ends of the arms 59, 56 that guide the slider 5 in the frame setback slider travel slot 85. Extended right arm 56 has a guide bump 50*d* that is longer than the other guide bumps. Right arm 56 also includes an impact shoulder 57 that engages with setback lock lever tip 43 (FIGS. 8 and 9) in the operation of the final assembly.

The setback slider 5 also includes an interlock catch 58 that engages the interlock hook 33 on the arming slider upper arm 33 (FIG. 4) if the arming slider assembly 3 moves rightward while the setback slider 5 is in its home position. The spring 7 is nested in a pocket between the slider arms 56 and 59 and is guided by them. The left arm 59 has a tapered portion 86 which assists the spring 7 in feeding back easily into the pocket after a temporary extension of the spring 7. The slider 5 is designed with extended arms 56 and 59 to increase its effective length in the slot 85 to avoid mechanical jamming or cocking of the slider 5 in the slot 85. The bias spring 7 is designed in a wavy or serpentine profile to improve the ability of the plastic mold "fingers" that define the spring 7 to keep their shape and support themselves during the plating, pressing or molding operation used to create the spring 7.

The number of repetitive zig-zag motions of the setback slider 5 caused by zig-zag racks 51 and 102 operating in coordinated zig-zag tracks 17 and 103 yields a programmed delay for a given acceleration input along the axis of the slider 5. Once the zig-zag racks 51 and 102 clear the track zig-zag features 17 and 103, the slider 5 can go into a "free fall" mode, picking up speed under a continued setback acceleration, and traveling far enough to insert and lock the setback slider latch head 52 into the setback slider latch socket 15. In so traveling, the impact shoulder 57 of the setback slider 5 impacts the setback lock lever tip 43 with sufficient energy to easily break the breakaway tab head 44 from the neck 45 so that the setback lock lever 4 is forcibly deflected downwards and held in place (See FIGS. 7–9). This action removes setback lock lever tab 42 from arming slider setback lock catch 34, and constitutes removal of the first safety lock from the arming slider 3. The latch head 52 and latch socket 15 of the setback slider 5 act similarly to the latch head 36 and latch socket 25 of the arming slider 3.

The setback slider track 85 is designed so that there is an adequate side-to-side space between the moving slider 5 and the track 85 to allow the zig-zag motion without binding. At each corner of the slider 5 is a guide bump 50*a*, 50*b*, 50*c*, and 50*d* used to position the slider 5 correctly in the track 85 to avoid mechanical jamming. There is a tapered portion 16 in the lower section of the track 85 to force the slider 5 into a centered position so that the latch head 52 can enter correctly into the latch socket 15. When the slider 5 is assembled into the track 85 during assembly, bias spring 7 must be extended to insert spring latch head 75 into spring head socket 18 to tension or pre-bias the spring 7. Gripper hole 77 may be used for this purpose. The spring latch head 75 must be drawn into the spring head latch socket 18 until latch barb pair 76 "clicks" into a latched position with the ends of the barbs 76 resting on catches 81, on each side.

Description of the Command Lock Rocker 6

Figure 6A:
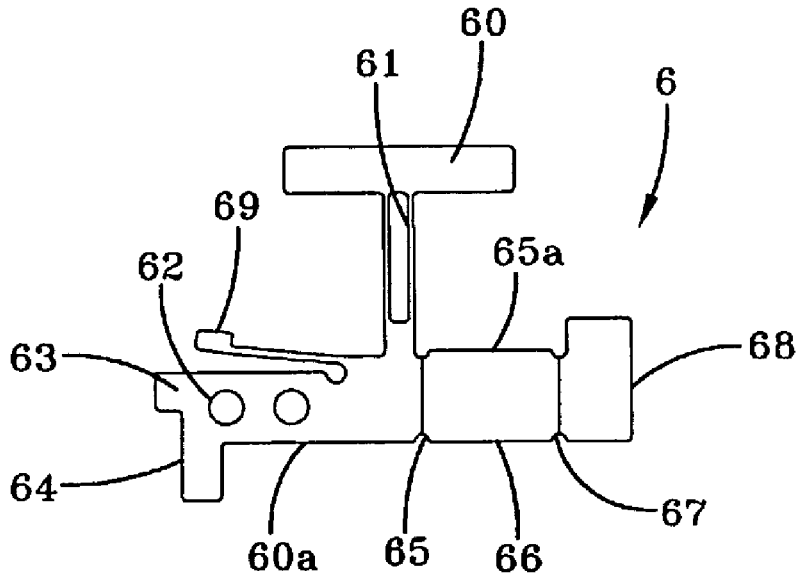
FIG. 6A is a plan view of a command lock rocker.
Figure 6B:
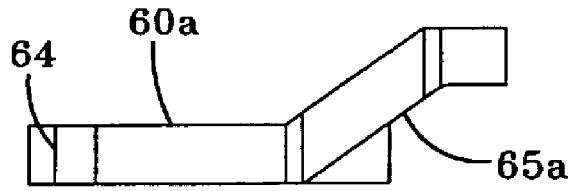
FIG. 6B is a side view of the command lock rocker of FIG. 6A.

FIG. 6A is a plan view of an embodiment of a command lock rocker 6. FIG. 6B is a side view of the command lock rocker 6 of FIG. 6A. The command lock rocker 6 includes an in-plane anchor section 60; a torsion bar section 61; a lower in-plane rocker arm 60*a* comprising a command lock enable catch tab 64, an anti-rotation guide tab 63, a tilt latch 69 and a plurality of lightening holes 62; a bend 65 for pivoting the rocker 6; and an inclined, out-of-plane arm 65*a* comprising a piston arm 66, another bend 67, and rocker piston tab 68. One purpose of the command lock rocker 6 is to engage catch tab 64 with arming slider command lock catch face 72 (FIG. 4) to prevent rightward motion of the arming slider 3 up until actuation of the command lock rocker 6.

Figure 13:
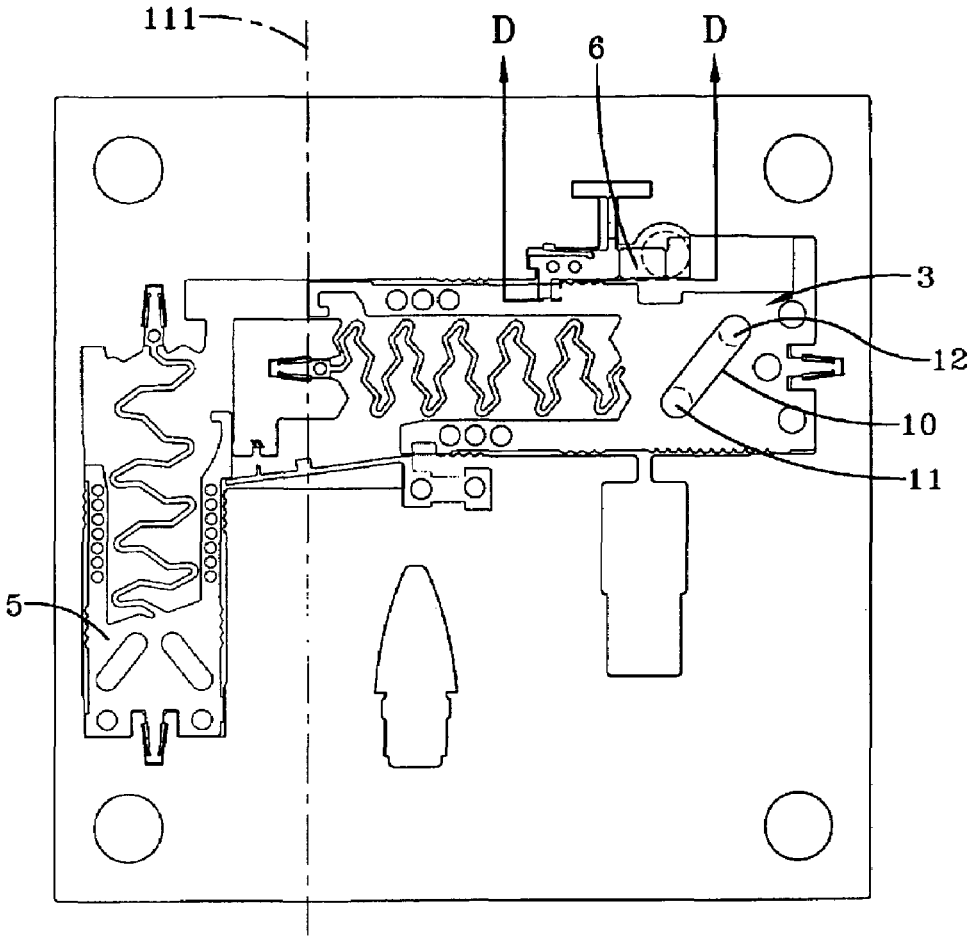
FIG. 13 shows a plan view of the MEMS device layer in an assembled, fully actuated and armed state, and shows the axis of spin rotation 111.
Figure 15:
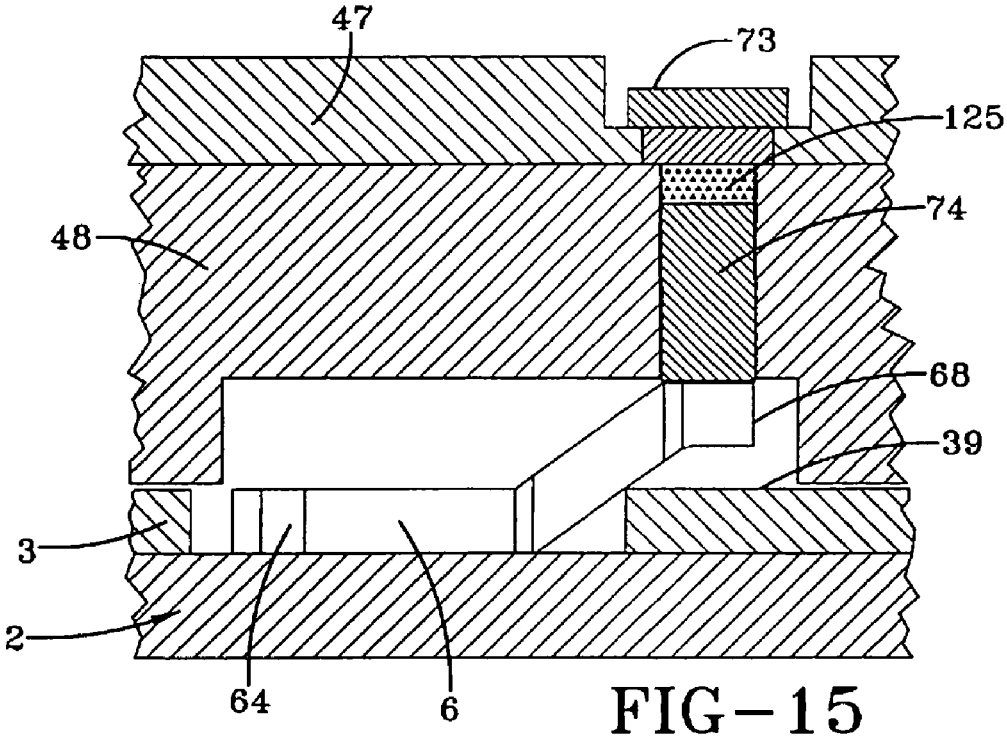
FIG. 15 is an enlarged sectional view of the command lock rocker taken along the line C—C in FIG. 2A, and shows the command lock rocker before actuation.
Figure 16:
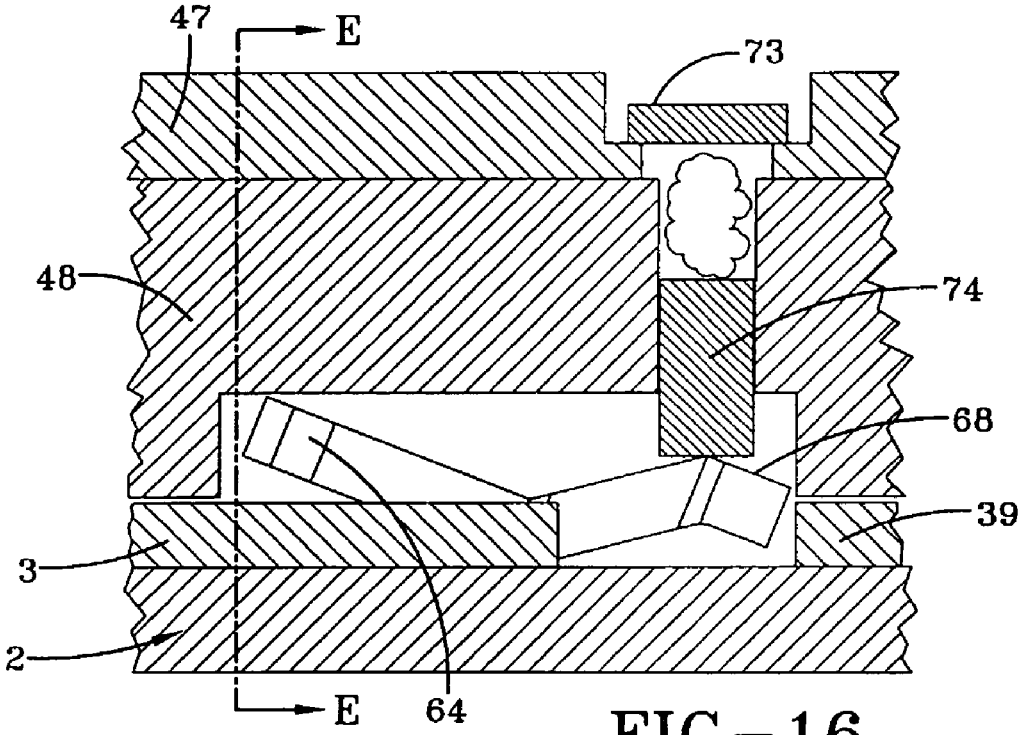
FIG. 16 is an enlarged sectional view of the command lock rocker taken along the line D—D in FIG. 13, and shows the command lock rocker after actuation.
Figure 17:
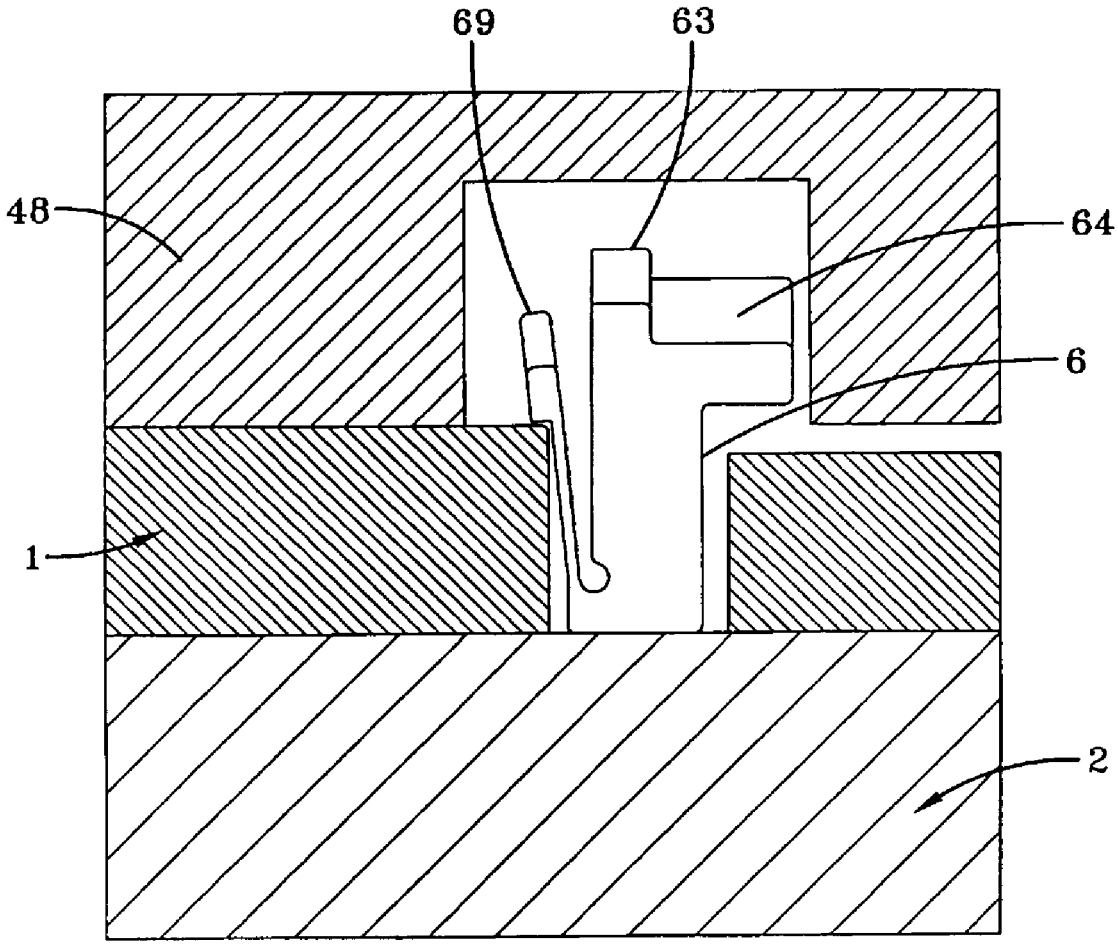
FIG. 17 is a cross section taken along the line E—E of FIG. 16.
Figure 18:
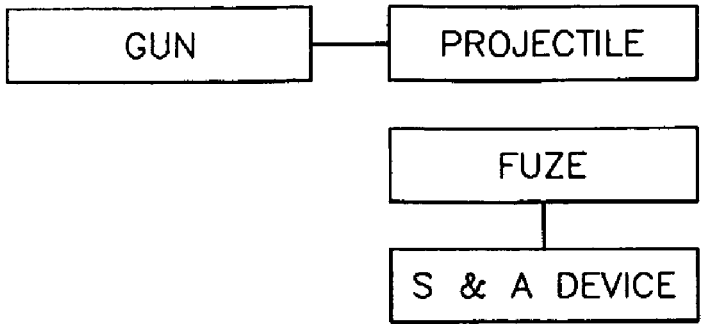
FIG. 18 shows a block diagram of the weapon system.
Figure 19:
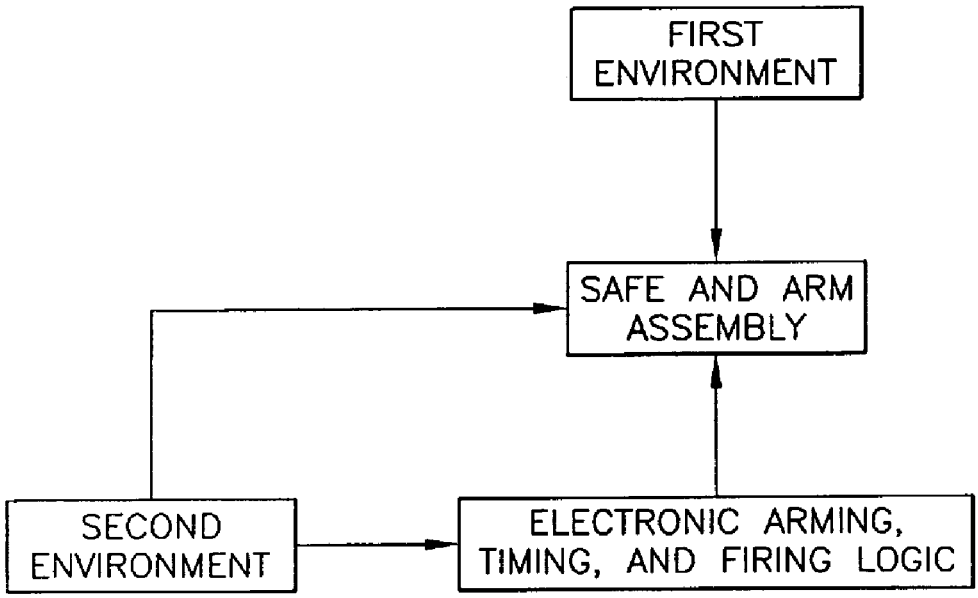
FIG. 19 shows a block diagram of a typical fuze employing the invention.

FIG. 15 is an enlarged sectional view of the command lock rocker 6 taken along the line C—C in FIG. 2A, and shows the command lock rocker 6 before actuation. FIG. 16 is an enlarged sectional view of the command lock rocker taken along the line D—D in FIG. 13, and shows the command lock rocker after actuation. FIG. 17 is a cross section taken along the line E—E of FIG. 16. The command lock rocker 6 is actuated by a piston 74 coming out of the cover plate assembly 48. Piston 74 impinges on piston tab 68 (FIG. 16) and pushes piston tab 68 toward the substrate 2. If arming slider preventer tab 39 (see also FIG. 4) is beneath the piston tab 68, the piston tab 68 is jammed against the arming slider preventer tab 39, pinning the arming slider preventer tab 39 down. In such a case, the catch tab 64 fails to disengage from command lock catch face 72 and the arming slider's 3 rightward motion is arrested. But if the arming slider 3 has already advanced partway to the right due to the presence of spin and the prior release of the setback lock lever 4, the preventer tab 39 will not interfere with downward motion of the piston tab 68, so that piston 74 actuation of the lock rocker 6 can proceed. If it does proceed, the result is that catch tab 64 is pivoted out of plane so that it no longer engages the command lock catch face 72 located on arming slider 3. If there is sufficient spin-induced acceleration, the arming slider 3 will now move to the right, toward arming, working against the force of the bias spring 9 (FIG. 16).

The rocker tilt latch 69 is shown compressed into place in FIG. 2A. When the command lock rocker 6 is actuated, the rocker tilt latch 69 is popped out as shown in FIG. 6A and FIG. 17 because the rocker tilt latch 69 is no longer confined by the frame 1. Once the rocker tilt latch 69 has popped out, the rocker tilt latch 69 engages with the top surface of the frame 1 (FIG. 17), and prevents the command lock rocker 6 from rotating out of its actuated position, which the command lock rocker 6 might otherwise do because of torque in the twisted torsion bar section 61.

The command lock rocker 6 is the second lock of the S&A device. It is anticipated that the lock rocker 6 may be fabricated using a MEMS technology. However, the lock rocker 6 may also be fabricated using a non-MEMS (e.g., conventional stamping) process employing a heat-treatable metal such as beryllium-copper, to obtain the bending strength needed.

Description of the Setback Lock Lever 4

Figure 7:
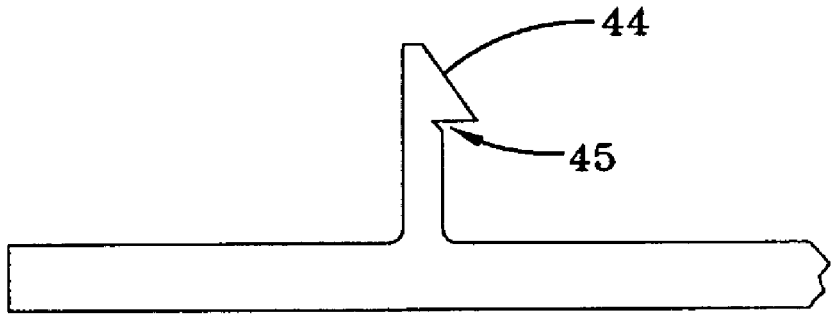
FIG. 7 is a plan view of details of the setback lock lever breakaway tab.
Figure 8:
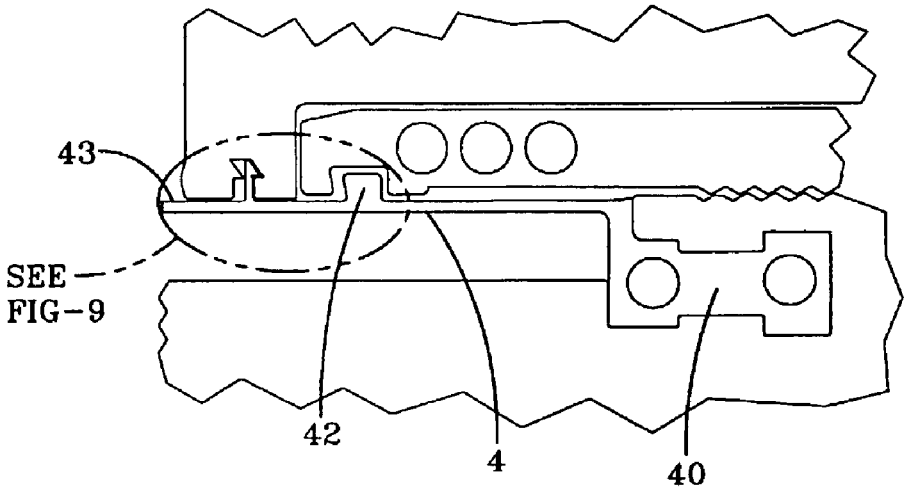
FIG. 8 is a plan view of the setback lock lever engagement.
Figure 9:
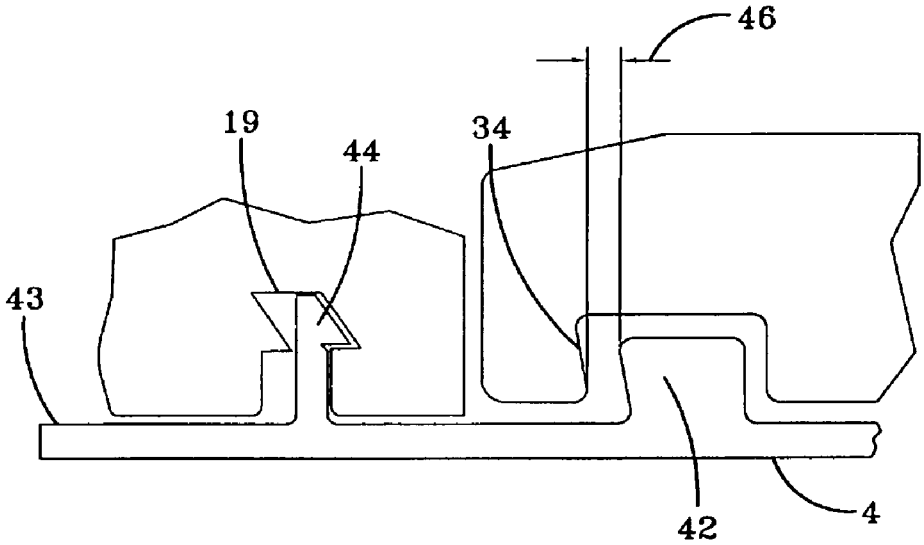
FIG. 9 is an enlarged plan view of a portion of FIG. 8.

FIG. 7 is a plan view of details of the setback lock lever breakaway tab. FIG. 8 is a plan view of the setback lock lever engagement. FIG. 9 is an enlarged plan view of a portion of FIG. 8.

The setback lock lever 4 shown engaged in FIG. 8 is secured in the assembly by insertion of the anchor 40 into the setback lock lever anchor socket 14. Thus placed, the lever 4 extends to the left to place setback lock lever tab 42 into the arming slider setback lock catch 34 with a setback sequence gap 46 (FIG. 9). The setback lock lever 4 also extends setback lock lever tip 43 into slider track 85 and inserts breakaway tab head 44 into setback lock lever breakaway pin socket 19. As explained previously, with launch setback acceleration, lever tip 43 will be impacted by setback slider impact shoulder 57 as the slider 5 moves downward in its track 85. The breakaway tab head 44 and its corresponding socket 19 are designed to very quickly break off the tab 44 at the stress-concentrating neck 45 shown in FIG. 7 when the setback slider 5 impacts the lever tip 43. It is a peculiar character of this design to act (fail) quickly by simultaneously exerting tension and bending stresses at the neck 45. However, the breakaway tab head 44 and neck 45 are strong enough to restrain motion of the lock lever 4 under its own inertial loading due to inputs of handling and transportation.

Figure 9A:
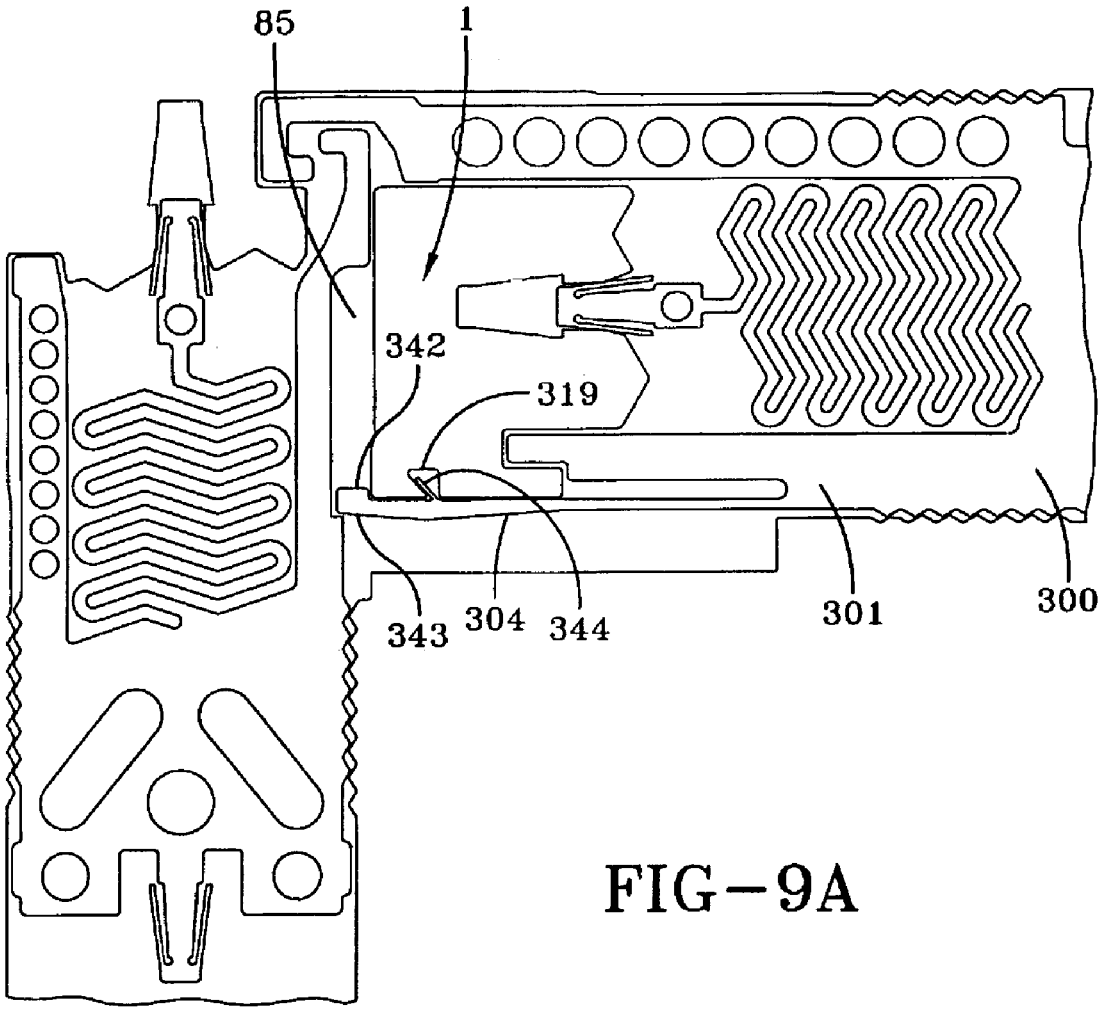
FIG. 9A is a plan view of an embodiment wherein the setback lock lever is a part of the arming slider.

FIG. 9A is a plan view of an embodiment wherein a setback lock lever 304 is a part of the arming slider 300. The setback lock lever 304 shown engaged in FIG. 9A is formed as part of a lower extended arm 301 of arming slider 300. Thus placed, the lever 304 extends to the left to place setback lock lever tab 342 against frame 1. The engagement of setback lock lever tab 342 against frame 1 prevents right-ward motion of the arming slider 300. The setback lock lever 304 extends setback lock lever tip 343 into slider track 85 and inserts breakaway tab head 344 into setback lock lever breakaway pin socket 319. As explained previously, with launch setback acceleration, lever tip 343 will be impacted by setback slider 5 as the slider 5 moves downward in its track 85. The breakaway tab head 344 and its corresponding socket 319 are designed to very quickly break off the tab 344 when the setback slider 5 impacts the lever tip 343.

Description of the Frame 1

The frame 1 shown in plan view in FIG. 3A comprises a durable solid material such as metal, plastic, or ceramic bonded to a silicon, metal, or plastic substrate 2 and having cutout patterns with generally vertical walls that are perpendicular to the plane of the substrate 2. The working parts of the final assembly are assembled into the cutout pattern in the frame 1. The frame cutout patterns situate and govern the motion of the parts to effect the mechanical logic of the design. Thus, the frame 1 of FIG. 3A comprises a pattern of slider tracks 85, 29 and 26; spring sockets 18 and 20; zig-zag tracks 17, 103, 21 and 28; lever and rocker anchor sockets 14 and 22; slider latch sockets 15 and 25, and so on, resting on a planar substrate 2 and guiding, constraining the motion of, or anchoring the diverse parts of the partial assembly shown in FIG. 2A.

Description of the Arming Detent Assembly 27

Figure 10:
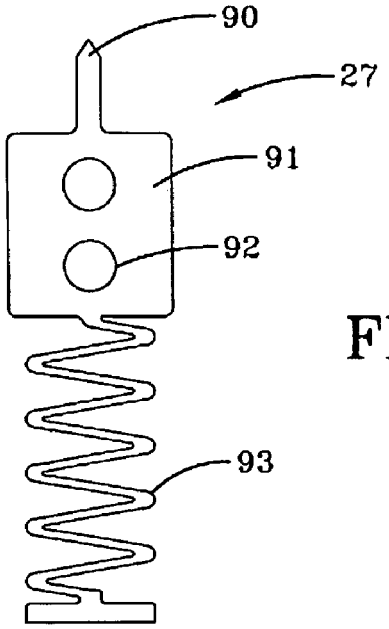
FIG. 10 shows a plan view of the detent slider assembly.

During normal operation of the invention, detent slider assembly 27, shown in plan view in FIG. 10, is omitted from the overall assembly. However, when it is desired to perform partial-arming tests of developmental micro-scale firetrain elements for safety qualification, the detent assembly 27 can be inserted and used to accurately position the arming slider 3 relative to output and input columns 11 and 12 (FIG. 2A). A series of detents 99 is fabricated into the arming slider 3 (FIG. 4) at regularly spaced positions between, on one extreme, that of being fully safe and, on the other extreme, that of being fully armed. The detents 99 are engaged by a slider pin 90 that is part of the detent slider assembly 27. The detent slider assembly 27 also includes the body 91 with grip hole pair 92 and compression spring 93. The assembly 27 is inserted as shown in FIG. 2A with the spring 93 compressed when such firetrain experiments are being made, so that the pin 90 forcibly engages the detents 99 to hold the arming slider 3 in a desired position.

Description of the latch and socket engagements.

Figure 20:
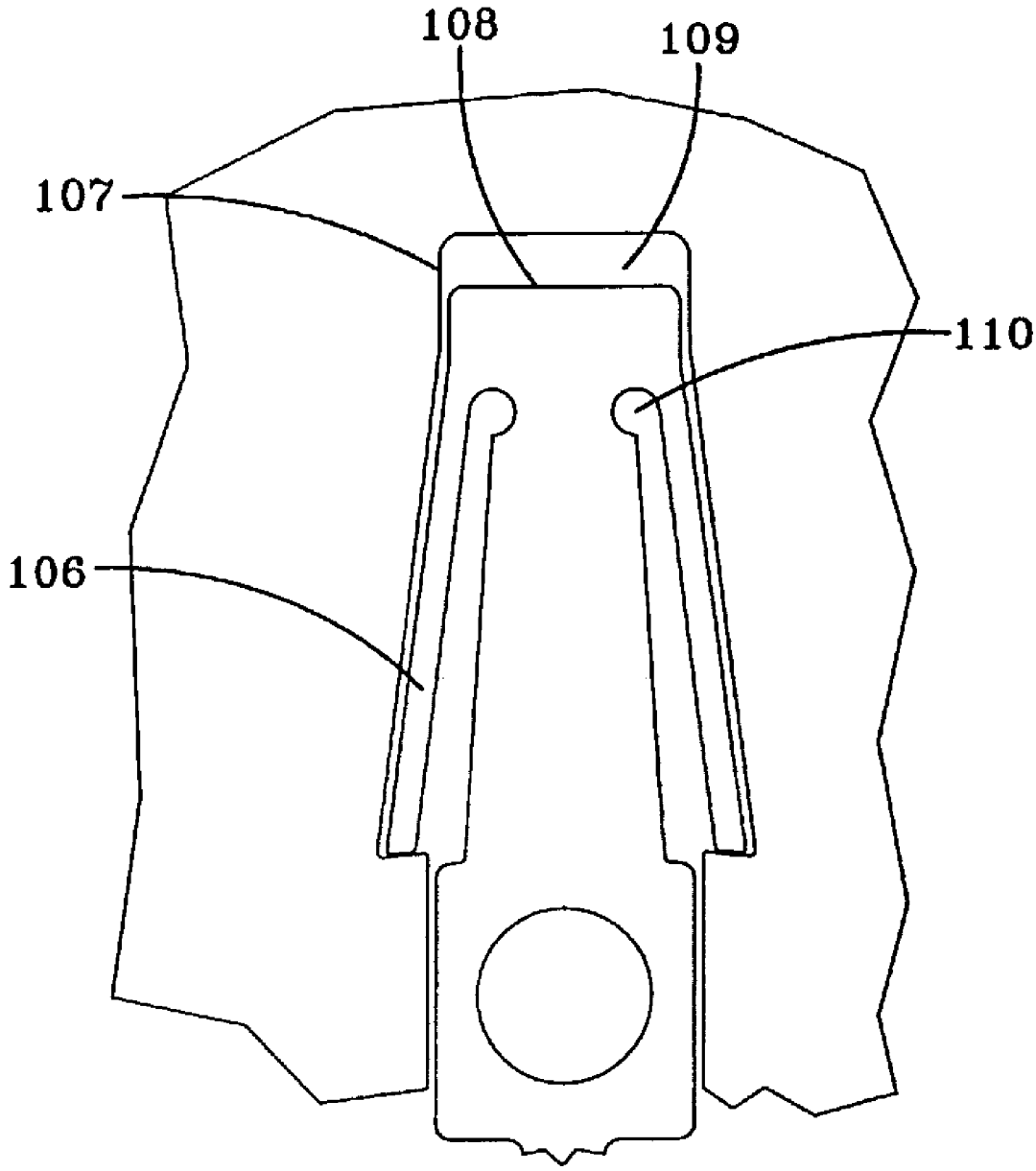
FIG. 20 shows a plan view of a latch and socket engagement.

The latch and socket engagements of the present invention have the following characteristics, particularly in comparison to the latch and socket engagement described in U.S. Pat. No. 6,167,809. As shown in FIG. 20, the latch barbs 106 are integrated with the moving parts (spring head or slider) rather than with the frame 1. The latch socket 107 is longer than the latch head 108, leaving a clearance space 109 so that full engagement of the latch is not prevented by any debris caught in the empty space between the top of the latch head 108 and the socket 107. A stress relief radius 110 is located at the base of the barbs 106 where they attach to the latch head 108, to improve manufacturability.

Description of the Cover Plate Assembly

Figure 11:
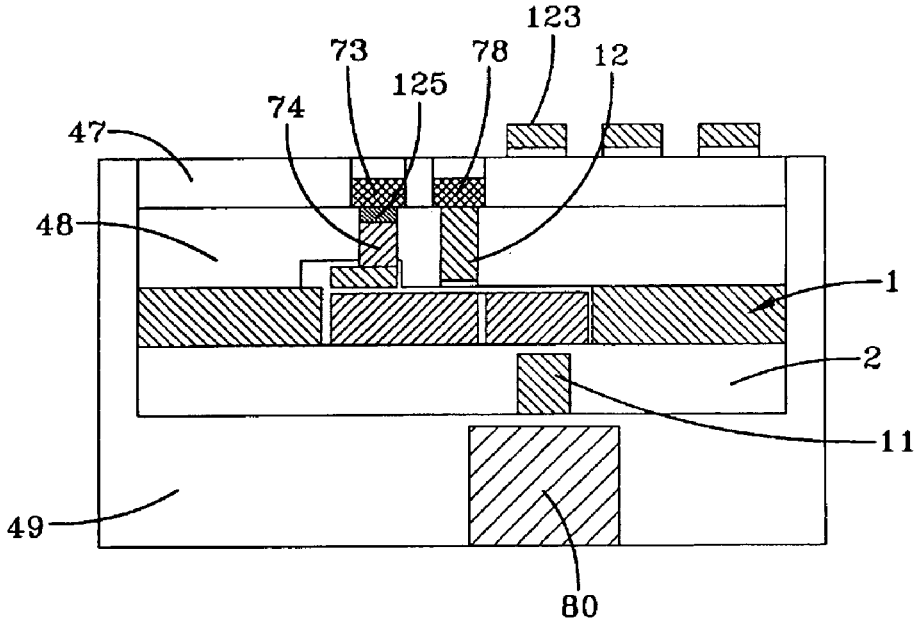
FIG. 11 shows a cross sectional view of the MEMS-based S&A assembly taken along the line F—F of FIG. 14.
Figure 14:
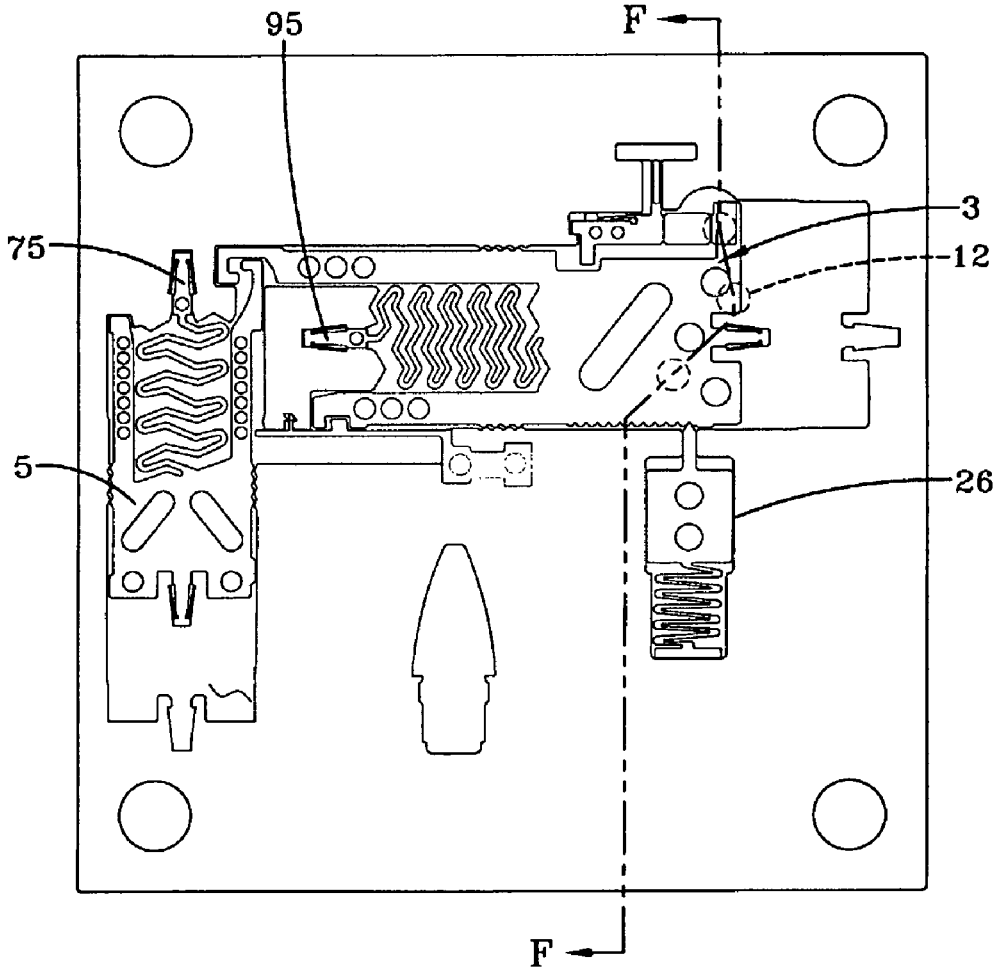
FIG. 14 shows a plan view of the MEMS device layer with springs pre-tensioned and components disposed as ready for packaging.

FIG. 11 shows a cross sectional view of the inventive MEMS-based S&A assembly taken along the line F—F of FIG. 14. In the completed assembly of the invention, shown in FIG. 11, the device layer frame 1 shown in FIG. 2A is sandwiched on one side by a cover plate assembly 48. The cover plate assembly 48 mates with the MEMS device die from above and provides a smooth planar constraint to keep all MEMS parts moving in plane with the frame 1. The cover plate assembly 48 also positions and confines the initiating firetrain "input column" 12 and positions and confines the piston 74.

Figure 30B:
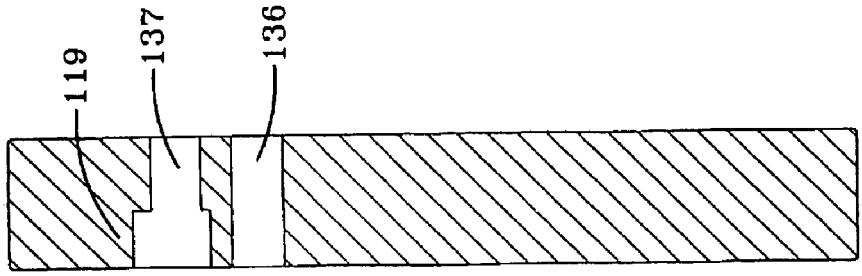
FIG. 30B is a sectional view of the cover plate taken along the line H—H in FIG. 30A.
Figure 30A:
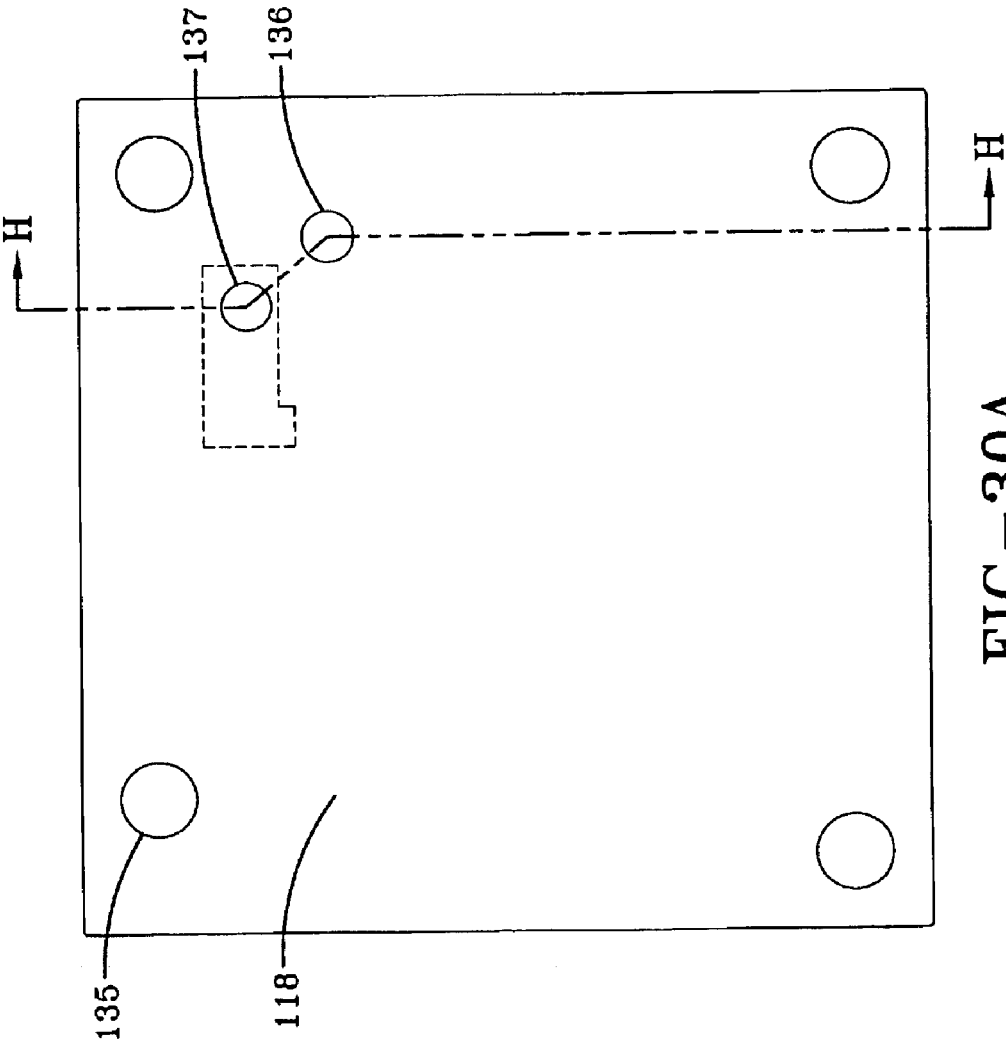
FIG. 30A is a plan view of the cover plate.

FIG. 30A is a plan view of the cover plate 118. FIG. 30B is a sectional view of the cover plate 118 taken along the line H—H in FIG. 30A. Cover plate 118 is part of cover plate assembly 48. Cover plate 118 includes piston through hole 137 for piston 74, input column through hole 136 for input column 12, pocket 119 for command lock rocker 6 and a plurality of cover plate pin through holes 135 for assembly purposes.

Description of the Explosive Initiator Assembly

As shown in FIG. 11, the cover plate assembly 48 is sandwiched on one side by an explosive initiator assembly 47. The explosive initiator assembly 47 mates with the cover plate assembly 48; positions and connects electrically to a firetrain thin film initiator 78; and positions and connects electrically to a piston thin film initiator 73. The explosive initiator assembly 47 also provides an electrical interface to the fuze circuit, preferably through electrical contact 123, or by some other means of electrical contact.

Description of the Invention Assembly and Explosive Train

The completed assembly of the invention comprises the device of FIG. 2A in a layered assembly as shown in the cross sectional view of FIG. 11. In the completed assembly, the biasing springs 7, 9 are prepositioned as shown in FIG. 14. Referring to FIG. 11, the parts of the completed assembly are arranged as follows: An electrical contact 123 attaches to the top of the explosive initiator assembly 47, and communicates with the firetrain thin film initiator 78 and piston thin film initiator 73. The initiator assembly 47 lays flat on top of the cover plate assembly 48 such that the explosive output of initiator 78 communicates with energetic elements of the input firetrain column 12 that is positioned in and confined by the cover plate assembly 48, and the explosive output of initiator 73 communicates with propellant charge 125. Propellant charge 125 moves piston 74 that is also positioned in and confined by the cover plate assembly 48.

The cover plate assembly 48 lays flat on top of the device of FIG. 2A (albeit modified as to the spring tensioning) which is the MEMS S&A assembly including the MEMS frame and parts, such that the explosive or energetic output of the input firetrain column 12 communicates with elements in the MEMS device layer such as, in particular, a transfer charge located in the transfer charge pocket 10, especially when the arming slider 3 is in its armed position. The energetic transfer charge in pocket 10 of the arming slider 3, when it is in the armed position, is able to accept the explosive front coming out of the input column 12, then begin and propagate its own explosive front traveling laterally the length of pocket 10 in the MEMS device layer to where the explosive front of the transfer charge can impinge on the output column 11 (FIG. 14).

When the arming slider 3 is in the armed position, the transfer charge explosively couples the input column 12 and output column 11 by laterally connecting them. If the arming slider 3 is not in the armed (explosive coupling) position, the transfer charge is aligned with neither the input column 12 or the output column 11, so the explosive front coming out of the input column 12 does not impact the transfer charge, so that the transfer charge does not ignite. Also, if the transfer charge did spuriously ignite while out of line, its output would not impinge on the output column 11. The explosive output of the transfer charge in pocket 10 of the arming slider 3 communicates with (propagates to) an output column 11 that is located in a blind hole in the underside of the substrate 2 and on the other side of a thin diaphragm.

The MEMS substrate 2 is fitted with explosive output assembly 49 which mates with and supports the underside of the MEMS planar substrate 2; positions and confines an output explosive charge 80 that receives the explosive output of the output column 11 and which then directs its explosive output (that of 80) toward an external target function or explosive charge associated with the warhead or a similar munition-level output function. This target function may be an initiating relay charge for a warhead. (Optional) assembly 49 may also form a housing around the above-mentioned structures to facilitate the overall assembly of the invention by helping to position and confine all the sandwich layers, as shown in FIG. 11, or by providing an interface to exterior structures such as the warhead or munition housing or fuze circuit.

Operation

During a Normal Launch Event:

During a normal launch event, and while in the gun tube, the projectile body in which the invention operates undergoes large setback acceleration in which all components of the projectile are set back axially toward the rear due to launch acceleration. The projectile body also undergoes an angular acceleration as it is spun up by the rifling in the gun tube. Once the projectile leaves the gun tube, the setback acceleration ceases but the spin continues at a more or less constant rate. The sequential action of setback, spin, and tube exit are the environments the invention exploits to validate launch and mechanically arm the weapon.

One purpose of the invention is to effectuate arming as a result of launch. Arming refers to the arming of the firetrain, which occurs when the arming slider 3 moves from it's left-most, "safe" position, as it is shown in FIG. 14, to the armed position at the right-most extent of its travel, shown in FIG. 13. Arming occurs when the explosive transfer charge contained in pocket 10 is aligned overlappingly with out-of-plane explosive input column 12 and out-of-plane output explosive column 11. Prior to arming, the transfer charge is positioned to not overlap, and therefore to not explosively couple, the input and output columns 12, 11.

Before Arming

Prior to launch the components of the invention are disposed as shown in FIG. 14. The slider springs 7 and 9 are tensioned, and the setback lock lever tab 42 is engaged in arming slider setback lock catch 34, and the command lock enable catch tab 64 is engaged with the arming slider command lock catch slot 71. The interlock catch 58 and hook 33 arrangement between the setback and arming sliders 5, 3 is capable of latching. The detent slider assembly 27 is omitted from the operational assembly of the invention.

During Setback and Spin-up

At the commencement of setback acceleration during launch, inertial forces begin to draw setback slider 5 downwards in its slot 85 toward a latching position at the bottom. During this initial stage, two things happen at the same time: First, the setback slider 5 moves far enough to where its interlock catch feature 58 is removed from a potential engagement with the arming slider interlock hook 33. Second, as the setback slider 5 continues to move downward, the engagement of the zig-zag racks 51, 102 with the zig-zag tracks 17, 103 causes a programmed delay, as has been described in Patent Nos. 5,705,767; 6,167,809; and 6,314,887; and also earlier in this document. The mechanical-inertial delay provides a certain amount of safety in that it takes a minimum sustained inertial input to successfully draw the slider 5 all the way down to its latched position while working against the restoring force of bias spring 7.

As the launch acceleration persists, the slider 5 moves through and then clears the zig-zag tracks 17, 103, and the impact shoulder 57 impacts and then depresses the setback lock lever tip 43 downward and holds it down when the setback slider latch head 52 locks into its socket 15. This impact and motion tears out the setback lock lever breakaway tab 44 and pulls the setback lock tab 42 out of its engagement with the arming slider 3. This process constitutes removal of the first safety lock.

Meanwhile, during the setback phase, the arming slider 3 cannot immediately move to the right under the influence of growing spin-induced acceleration because the acceleration has the effect of forcing the arming slider 3 down into its zig-zag track 21, 28 engagement. This feature adds another measure of safety to the invention because the arming slider 3 cannot possibly move to the armed position so long as the projectile is undergoing launch setback acceleration.

After Tube Exit

Upon tube exit, setback acceleration ceases while spin-induced acceleration continues. The arming slider 3 now shifts to the right under the influence of spin acceleration and working against bias spring 9, until the catch face 72 is stopped by command slider catch tab 64. The catch tab 64 limits the slider 3 to this extent of travel until the command lock rocker 6 is actuated. The arming slider 3 will move rightward only if there is sufficient spin-induced acceleration to exceed the safety-biased spring force of spring 9.

Upon tube exit there is a so-called set-forward acceleration induced in the invention due to aerodynamic drag. This acceleration would tend to lock the arming slider zig-zag rack 31 into the arming slider zig-zag track 21, but in reality it is of such small magnitude compared to spin-induced forces that it cannot prevent the arming slider 3 from moving to the right toward arming.

Command Arming

The command lock rocker 6, which interrupts the progress of the arming slider 3 toward arming during spin, is actuated by the fuze circuit which fires a piston 74 downward (normal to the view plane in FIG. 2A) onto the rocker piston tab 68. A cross sectional view of the situation is shown in FIG. 15, with the tab 64 engaging the arming slider catch face 72. With the actuated piston 74 pressing down on the piston tab 68 and lowering the inclined right arm 65*a* of the lock rocker 6, the left, lower rocker arm 60*a* is raised as it pivots around the torsion bar section 61 at the pivot bend 65 so that the catch tab 64 is pulled away from the arming slider catch face 72. In addition, at the same time, the rock tilt latch 69 latches on top of the frame 1 preventing re-engagement of the lock rocker 6 with the arming slider 3. With the lock rocker 6 in its actuated position, as shown in FIG. 16, the arming slider 3 is now free to move rightward under spin-induced forces to the end of its slot 29 where it latches in place (head 36 into socket 25). There is a small delay as the slider negotiates the zig-zag tracks 21 and 28.

Detailed Explanation of the Invention Mechanical Logic

Setback must occur before spin and must be of sufficient amplitude and duration to bring the setback slider 5 down and into the locked position. If spin or lateral—acceleration occurs before setback and the setback lock lever 4 has failed or is missing, the arming slider interlock hook 33 will grab the setback slider interlock catch 58 and retain the arming slider 3 and setback slider 5 in a safe position. Note that prebias tension on spring 7 will tend to force and retain the interlocking action between hook 33 and catch 58.

If setback is of insufficient amplitude or duration the setback slider 5 will descend for a few clicks of the zig-zag tracks 17, 103, but will be unable to break the setback lock breakaway tab 44, and then will be reset to zero deflection by the tension of the prebiased spring 7. Spin must be present before the command lock rocker 6 can be actuated. If spin is not present, the command lock preventer tab 39 will interfere with the descent of the rocker piston tab 68 because the preventer tab 39 has not moved out of the way. The command lock rocker 6 must be functioned by an intelligent and purposeful signal from the fuze controller circuit. The intelligence has to do with correct timing of the action in relation to other events as the invention operates. If the piston 74 fires down on the rocker piston tab 68 prematurely, while the arming slider 3 still has its preventer tab 39 under piston tab 68, this would result in only partial rotation of the lock rocker 6 and would leave catch tab 64 engaged with the arming slider 3, preventing the arming slider 3 from moving. The spin-motivated arming slider 3 will move from its safe to its armed position only in the presence of a sustained sideward loading such as that produced by sustained spin of the munition. This is because of the several mechanical locks that prevent its motion and the need of the slider 3 to traverse the zig-zag tracks 21, 28. If the several mechanical locks were disengaged from the arming slider 3, it would still take some time for the slider 3 to negotiate the zig-zag tracks 21, 28. This integration translates to additional handling-drop safety.

The bias spring 9 will tend to reset the arming slider 3 to a safe position (toward the left of FIG. 4) in the absence of a strong sideward load toward the right, such as that induced by spin acceleration.

The spin-motivated arming slider 3 will move from its safe to its armed position only after the cessation of setback acceleration, as when the projectile leaves the gun tube. This is because setback acceleration has the effect of pressing the lower zig-zag rack 101 of the arming slider 3 into the lower zig-zag track 28, such engagement effectively preventing sideward motion of the arming slider 3.

Response to Non-Launch Inputs

Before loading in the gun, the projectile may be exposed to many types of dynamic inputs as a result of transportation and handling. These include impacts from handling drops and vehicle vibration as well as other inputs. The mechanical logic of the present invention discriminates spurious inputs from valid launch inputs as follows:

Respond and Reset The mechanical logic of the invention will allow a partial response followed by a resetting to a starting or "ready" position as a result of the following inputs or events. When setback acceleration force induced on setback slider 5 exceeds the bias threshold of pre-tensioned spring 7, the setback slider 5 is drawn downward in it track 85. If the setback pulse is too short in duration, the slider 5 does not go very far because of the interruption of motion due to the zig-zag track 17, 103 engagement, and the spring 7 draws the slider 5 back up the track 85 into the start position. If the setback pulse is too low in magnitude, the slider 5 only goes partway down the track 85 in static deflection, and when the acceleration field desists it is similarly drawn upwards once again by the biased spring 7 back up into its start position. Thus the response to setback inputs that are too low or too brief is that the invention device deflects only partway and then re-sets the setback slider 5 to its start position, ready to respond to the next inertial input.

The bias spring 9 will draw the arming slider 3 back to its leftmost (start) position if the arming slider 3 deflects to the right but fails to latch in the armed position, and there are insufficient inertial loads to overcome spring bias force.

Fail-to-Safe Operation The mechanical logic of the invention will force a fail-to-safe condition as a result of the following inputs or events: When spin- or impact-induced side loads occur before setback forces have moved the setback slider 5 somewhat downward in its track 85, the arming slider interlock hook 33 will engage with setback slider interlock catch 58, preventing arming slider motion until such side load desists. When the load desists, tension in the pre-tensioned (pre-biased) arming slider spring 9 will draw the arming slider 3 back to its left-most position, disengaging the interlock and thus re-setting the invention assembly to sense the next inertial input.

Safety is preserved in a case where there is a premature command-arm signal from the fuze circuit that tries to actuate the command lock rocker 6. The command lock rocker 6 is "enabled" only when the following conditions are met (see block diagram of FIGS. 1A and 1B): a) the setback lock lever tab 42 has been removed from its-engagement with the arming slider 3; b) setback acceleration has terminated, and c) there is a spin-induced sideward acceleration field. If the command lock rocker 6 is actuated prematurely, that is, the piston 74 tries to force the rocker piston tab 68 downward before the arming slider 3 has moved sufficiently to the right, the rocker piston tab 68 will press down on the arming slider preventer tab 39. This will prevent rocking and therefore will prevent removal of the second lock, the command lock enable catch tab 64.

If the spin rate is insufficient to propel the arming slider 3 all the way to the armed and latched position, the end-of-travel latch head 36 and latch socket 25 do not engage. The result is that upon decay of the spin during flight or as a result of the projectile coming to rest, the arming slider 3 will be retracted to the safe (explosives out of line) position by the arming slider bias spring 9.

Antimalassembly Features

The setback slider 5 cannot be assembled in the frame 1 in a reverse orientation. The arming slider 3 cannot be assembled in the frame 1 in a reverse orientation. The setback lock lever 4 cannot be assembled in the frame 1 in a reverse orientation. The command lock rocker 6 cannot be assembled in the frame 1 in a reverse orientation. The cover plate assembly 48 cannot be assembled in a reverse orientation because of asymmetrical assembly holes.

Fabrication and Assembly

FIG. 17 is a cross section taken along the line E—E of FIG. 16. The full assembly is shown in cross section in FIG. 17.

Preferred Method of Construction

The substrate 2 is metal sheet approximately 500-microns thick The frame 1 is of plated metal, approximately 200- to 300-microns thick, with a cutout pattern and have geometry and feature dimensions accurate to within about plus or minus 1-microns. The frame 1 may be fabricated using a wafer-based MEMS-type microfabrication method directly, or may be printed or molded in a derivative replication process. The preferred direct wafer-based process is known as LIGA (Lithographie, Galvanoformung, Abformung) in which a deep PMMA photoresist layer is exposed to x-ray photons in a synchrotron, developed, and plated-into using nickel to form high-aspect-ratio structures. An indirect method can start with the LIGA-formed structures and use them as a form or master to emboss or mold replica structures which are then plated into, and so on.

The frame 1 and substrate 2 are bonded together to form a single part. The moving parts of the assembly—the setback slider 5 including spring 7, the arming slider 3 including spring 9, the setback lock lever 4, and the command lock rocker 6—are all metal, preferably nickel, and have geometry and feature dimensions accurate to within about plus or minus 1-microns. The parts may be fabricated using a wafer-based MEMS-type microfabrication method such as LIGA directly, or may be embossed or molded and then plated in a derivative replication process as described above. Automated micro-assembly techniques are used to insert sliders, locks and springs in their proper places in the proper order. The spring heads are mechanically drawn up into their latch sockets to tension the springs. Assembly is checked using automated machine vision inspection.

The explosive transfer charge is placed in the arming slider 3. The cover plate assembly 48 is fitted on top of the frame 1. The explosive initiator assembly 47 is fitted on top of the cover plate 48. The above "sandwich" assembly is fitted into the explosive output assembly and housing 49. The resulting module is sealed and ready for installation in the fuze.

Alternative Materials of Construction

A lower overall cost for the S&A assemblies can be realized by fabricating high-precision parts, such as the springs, in a direct micromachining process such as LIGA, and fabricating the parts that demand somewhat less precision, such as slider bodies and frames, in a less expensive embossing or injection-molding and then plating process. This eventuality is prepared for in the invention by the design shown in FIG. 12 in which springs that are fabricated in a process separate from the sliders are joined to the sliders by inserting the spring insertion plug 88 into the spring socket 87. In regard to the economic feasibility of this, about 4000 springs of the type shown in FIG. 12 can be fabricated simultaneously on a single 150-mm (6-inch) silicon wafer. From the same basic design or plan, the invention can be realized with a variety of sensitivity thresholds for different munition applications, depending on specific design factors such as contact gaps, spring stiffness, slider mass, selection of materials of construction, or specifications of features and geometry or design goals such as inertial thresholds.

Description of a Second Embodiment

A second embodiment of the invention is the same as the first embodiment as shown in FIG. 2A except that the end-of-travel arming slider latch head 36 and latch socket 25 are omitted. This omission has the effect that if the spin decays before the munition is functioned by the fuze, the arming slider 3 will be retracted to the safe (explosives out of line) position by the arming slider bias spring 9. This feature is indicated by the dotted line and box titled "If No Arming Slider Latch" in the block diagram of FIG. 1B.

Description of a Third Embodiment

Figure 21:
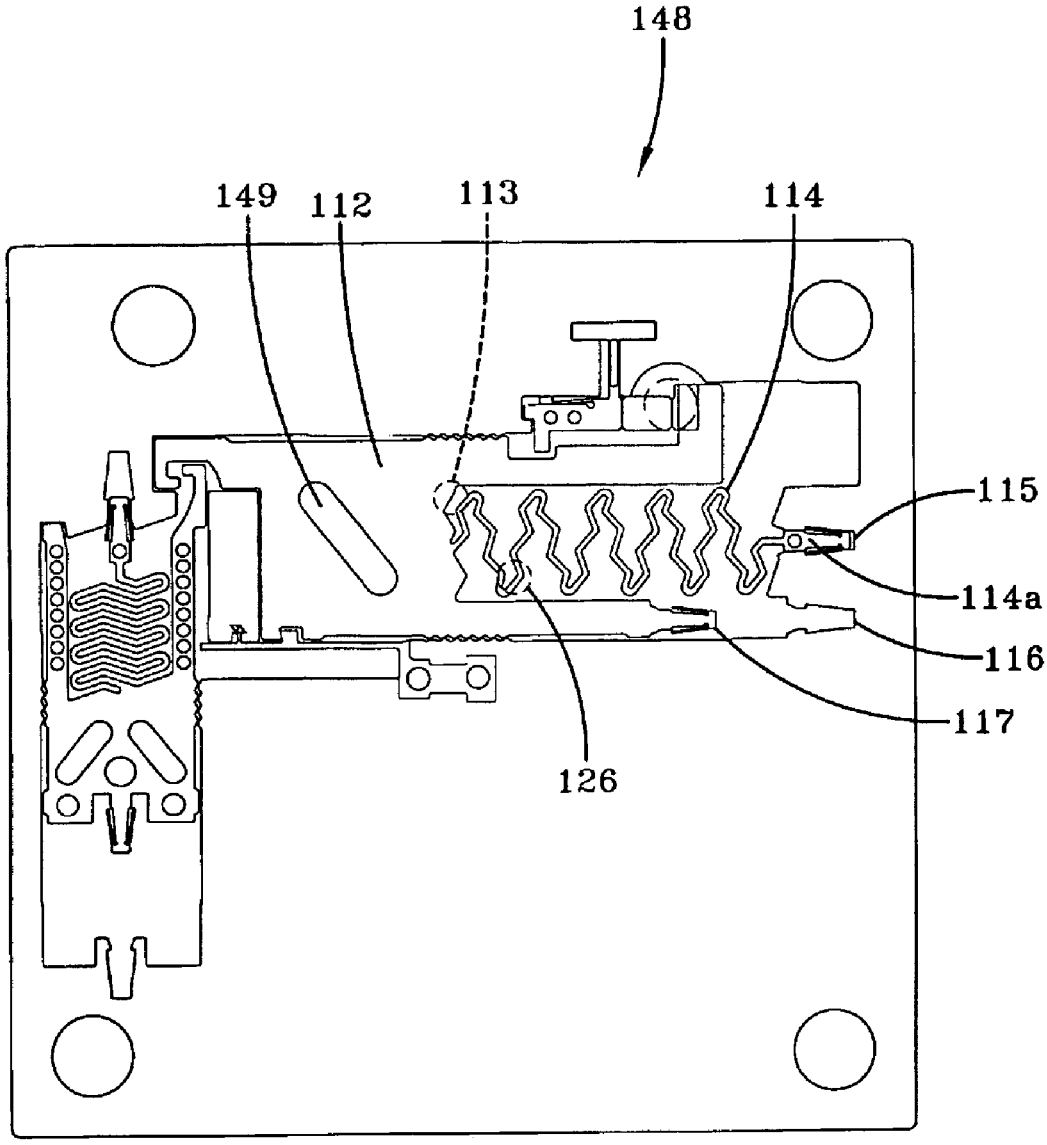
FIG. 21 shows a plan view of a reverse-bias S&A device for a non-spin munition launch.

FIG. 21 shows a plan view of a reverse-bias S&A device for a non-spin munition launch. A third preferred embodiment 148 for non-spin munitions shown in FIG. 21 comprises an assembly similar to that of FIG. 2A but with a different arming slider 112. In arming slider 112 the location of the transfer charge pocket 149 and its associated input column 113 and output column 126 has been changed to accommodate a reverse-bias spring 114. Reverse-bias spring 114 is tensioned by extending its latch head 114*a* into reverse-bias spring latch head socket 115. Arming slider 112 includes arming slider latch 117 and arming slider latch socket 116.

This third embodiment 118 functions as a miniature MEMS-based electro-mechanical S&A for gun-launched munitions that are not spin stabilized. Munitions without spin stabilization lack a significant centrifugal acceleration-induced spin component to drive the arming slider 112 toward the armed position, so a spring force is substituted by this design. The spring 114 is pre-biased toward arming before the S&A device is packaged, and the arming slider 112 is held in its safe position by the same first and second locks as were implemented in the design of FIG. 2A.

The sequence of operation is similar to operation of the device of embodiment one (FIG. 2A). Under setback acceleration the setback slider goes down, and removes a first lock on the arming slider 112, while also removing the possibility of a hook and catch engagement between the setback and arming sliders. So long as setback is sustained, a zig-zag track engagement of slider 112 retains the slider in its safe position. Upon cessation of setback (tube exit), and with the setback lock lever removed, the arming slider 112 is drawn rightward by the tensioned spring 114 until a catch face on the slider 112 contacts a stop tab on a second lock (see description of lock rocker 6 engagement of embodiment 1). When the second lock is removed by command of the fuze circuit, the arming slider 112 is drawn further rightward by the tensioned spring 114 until it locks in the armed position by engagement of latch 117 into latch socket 116. By this process the device 118 of embodiment 3 provides the safety of two independent locks on the arming slider 112 while functioning by the motivating forces of setback and a pre-tensioned spring.

Description of Inspection Holes

Figure 22:
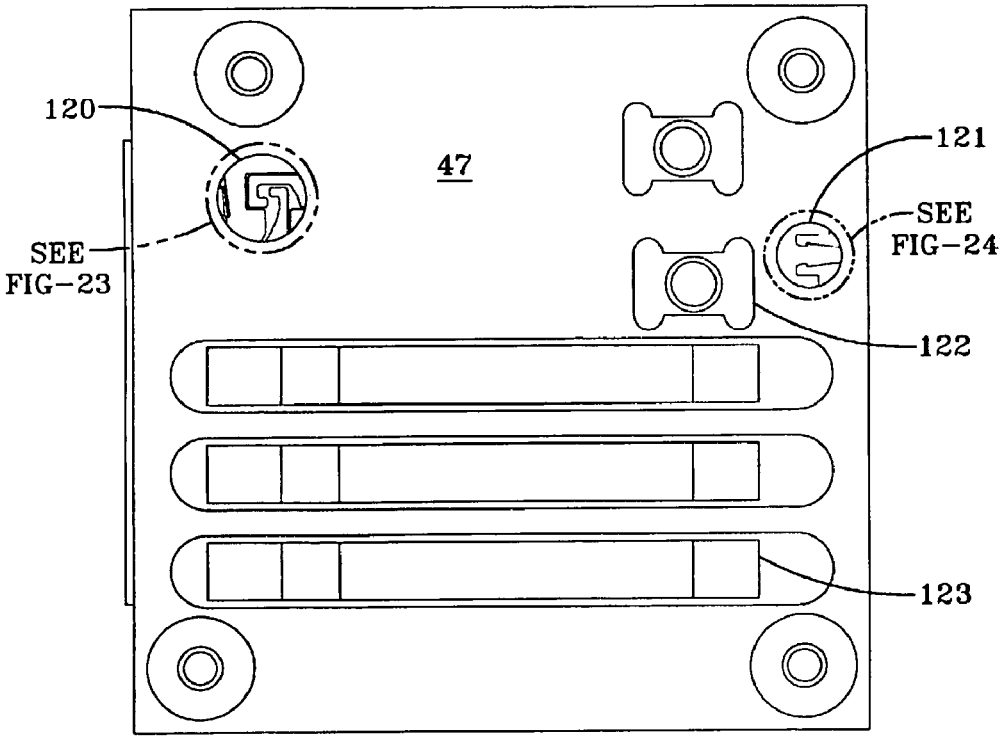
FIG. 22 is a plan view showing the location of and view through a safe inspection hole and an armed inspection hole with components of the S&A disposed in a safe condition.
Figure 23:
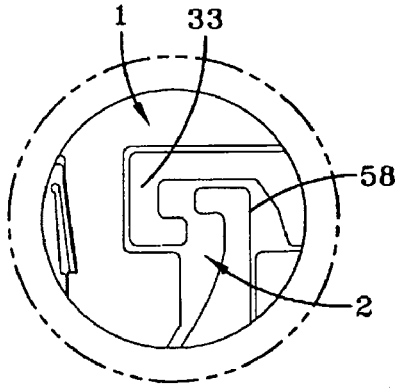
FIG. 23 is an enlarged view of the safe inspection hole with components of the S&A disposed in a safe condition.
Figure 24:
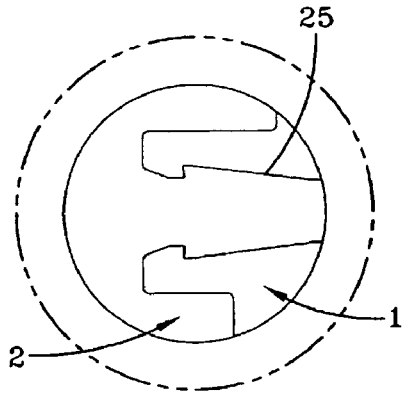
FIG. 24 is an enlarged view of the armed inspection hole with components of the S&A in a safe condition.

FIG. 22 is a plan view showing the location of and view through a safe inspection hole and an armed inspection hole with components of the S&A disposed in a safe condition. FIG. 23 is an enlarged view of the safe inspection hole with components of the S&A disposed in a safe condition. FIG. 24 is an enlarged view of the armed inspection hole with components of the S&A in a safe condition.

In FIG. 22, the explosive initiator assembly 47 incorporates viewing ports or inspection holes by which the safe or armed status of the arming slider may be determined by viewing features through one or more windows in the cover or packaging of the assembled device. The safe inspection hole 120 shows the status of the engagement of the arming slider interlock hook 33 with setback slider interlock catch 58. The armed inspection hole 121 shows the status of the engagement of the arming slider latch head 36 into the arming slider latch socket 25. If the hook of the arming slider 3 is visible, as shown in FIG. 22, the arming slider 3 is in its safe position. At the same time, the view through the armed inspection hole 121 will show no part of the arming slider 3, thus a safe condition. Also shown in FIG. 22 are electrical contacts 123 and initiator chip pockets 122.

Figure 25:
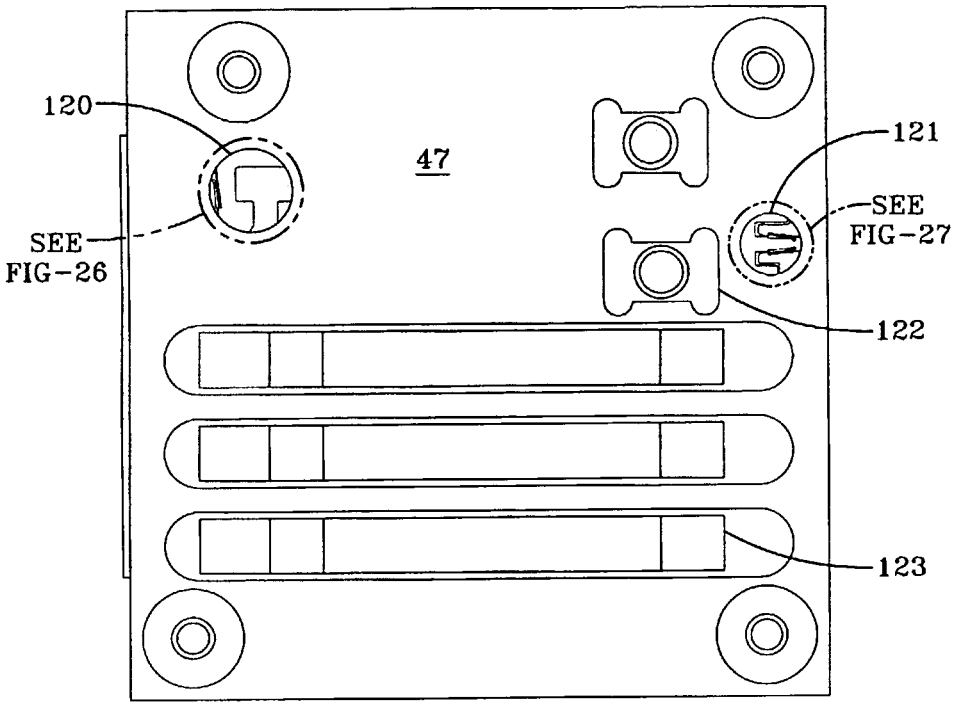
FIG. 25 is a plan view showing the view through a safe inspection hole and an armed inspection hole with components of the S&A disposed in an armed condition.
Figure 26:
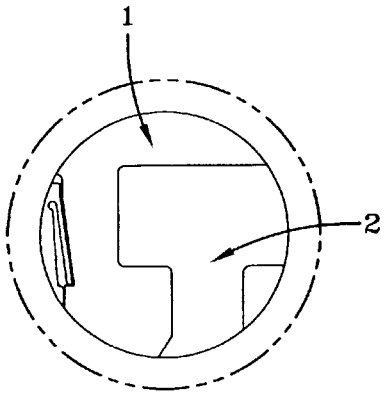
FIG. 26 is an enlarged view of the safe inspection hole with components of the S&A disposed in an armed condition.
Figure 27:
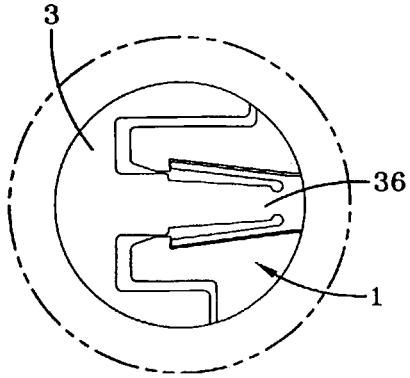
FIG. 27 is an enlarged view of the armed inspection hole with components of the S&A in an armed condition.

FIG. 25 is a plan view showing the view through a safe inspection hole and an armed inspection hole with components of the S&A disposed in an armed condition. FIG. 26 is an enlarged view of the safe inspection hole with components of the S&A disposed in an armed condition. FIG. 27 is an enlarged view of the armed inspection hole with components of the S&A in an armed condition. If the arming slider latch head 36 is visible through the armed inspection window 121 and is latched into socket 25 (FIGS. 25 and 27), this indicates the arming slider is in the armed position. At the same time, the view through the safe inspection hole 120 will reveal that the arming slider hook 33 is no longer visible. The setback slider catch 58 may or may not be visible at the same time, depending on whether it successfully latched down after removing the first lock.

Transfer Charge Alternatives

Figure 28A:
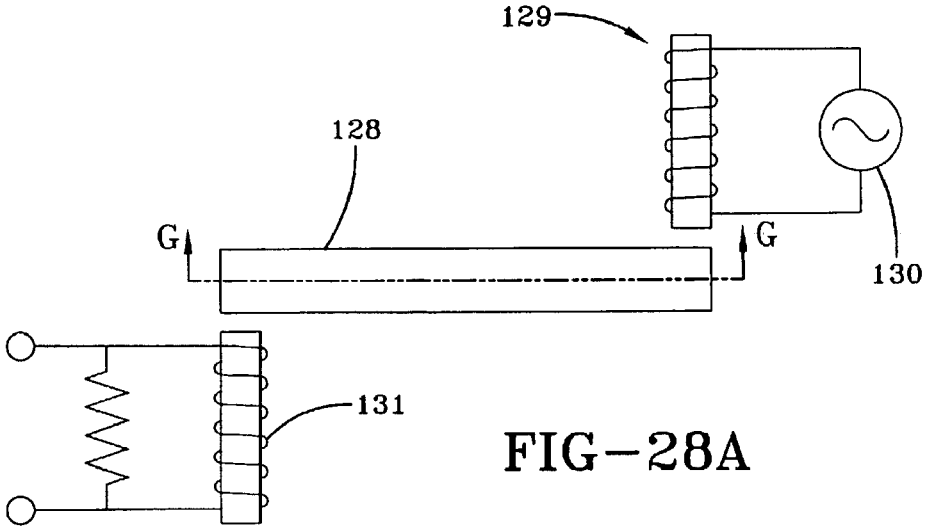
FIG. 28A shows a side view of an inductive coupling alternative to an energetic transfer charge.
Figure 28B:
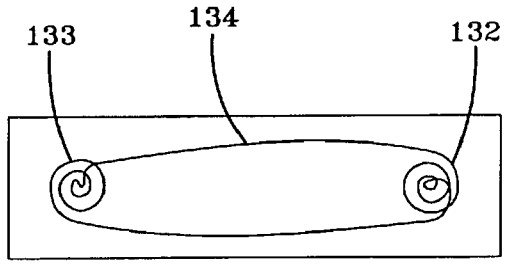
FIG. 28B is a sectional view along the line G—G of FIG. 28A showing the inductive coil pair inside an inductive coupler assembly.

Heretofore, the transfer charge that is inserted in the transfer charge pocket 10 of the arming slider 3 has been described as an energetic charge that explosively couples the input and output columns of the assembly such that an explosive output coming from the input column 12 is relayed through the transfer charge to initiate the output column 11. FIG. 28A shows a side view of an inductive coupling alternative to an energetic transfer charge. FIG. 28B is a sectional view along the line G—G of FIG. 28A showing the inductive coil pair inside an inductive coupler assembly. In the inductive coupling design, the energetic transfer charge is functionally replaced by an inductive or ferromagnetic coupler assembly 128. The coupler assembly 128 may comprise, for example, a ferromagnetic slug that is mechanically moved into place by arming so that a magnetic field or flux output from driven input coil assembly 129 (which replaces explosive input column 12 in the earlier embodiments) is relayed by the coupler 128 to induce current in a receptor coil 131. The receptor coil 131 replaces explosive output column 11 in the earlier embodiments, and the input coil assembly 129 is being driven by alternating current source 130. The receptor coil circuit 131 may perform some useful function such as initiating a propellant or functioning as an electronic circuit.

The coupler assembly 128 may be as simple as a shaped piece of ferromagnetic material or as complex as an embedded micro-circuit consisting of at least two connected inductive coils. In a micro-circuit type coupler, see FIG. 28B, for example, current induced in a coupler receiving coil 132 by magnetic flux emitted from the input coil assembly 129 travels through connecting wires 134 and through the coupler emitter coil 133 in a closed circuit. The emitter coil 133 in turn generates a magnetic flux output that interacts with receptor coil 131. The two coils 132, 133 in the micro-circuit need not have the same number of windings, so that the inductive coupler may also function as a voltage transformer. A micro-circuit coupler such as has been described is feasible based on current-day MEMS fabrication technologies. Receptor coil 131 may be replaced in the overall assembly by an induction sensor, an inductive coil connected to a circuit, a ferromagnetic pole of a magnetic circuit, a magnetic reed switch, or other magnetically actuated device. The arming slider is mechanically moved into place by arming so that a flux pulse from input inductive coil assembly 129 is relayed by the inductive or ferromagnetic coupler assembly 128 to induce a magnetic flux output to the receptor coil 131.

Figure 29:
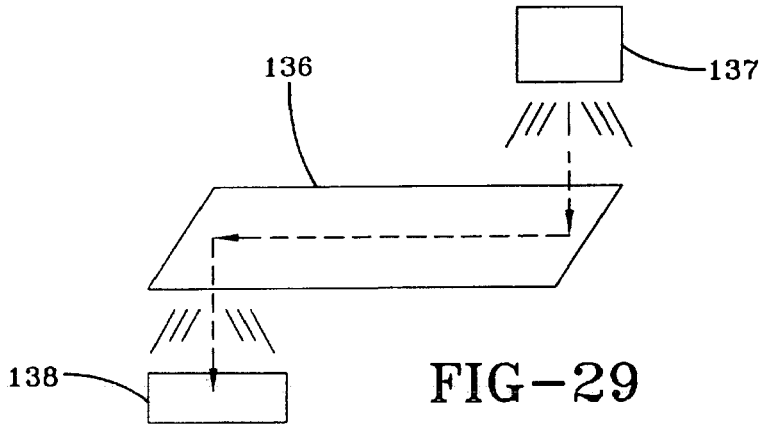
FIG. 29 shows a side view of an optical coupling alternative to an energetic transfer charge.

FIG. 29 shows a side view of an optical coupling alternative for the energetic transfer charge. In FIG. 29, the aforementioned transfer charge or transfer assembly is functionally replaced by an optical coupler 136 that is mechanically moved into place by arming of the arming slider 3 so that an optical input (whether in the visible light range or outside of that) from input light source 137 is relayed optically by the optical coupler 136 to become output to optical sensor 138. What is depicted in FIG. 29 is a simple "periscope" prism type implementation, but a fiber optic implementation of the same is also feasible. The optical sensor is part of a fuze circuit that makes use of the arming input.

Alternative Methods of Construction

With developments in the industry it will be possible to form most or all of the features of the device, including the frame, the substrate, and the "parts," by advanced replication techniques such as micro-injection molding or hot-embossing mold transfer processes rather than a direct micromachining technique. A direct high-aspect-ratio LIGA micromachining process, for example, requires each wafer to be exposed in a synchrotron or by other suitable means, which can be expensive. But a manufacturing process is envisioned in which a conventional high-aspect-ratio micromachining process such as LIGA can be used to create a precision master mold tool that is used to print additional molds for plating new mold tools. The produced generation of mold tools can then be used to "print" or emboss parts and frames, or to "print" or emboss multiple plating molds for additional parts or frames, and so on. By such replication of the "printing" or embossing tools, large numbers of parts or frames can be turned out inexpensively. The firetrain elements can be made by pressing explosive-compound pellets, or pressing or slurry loading explosive compounds into cavities.

Some Advantages Over the Prior Art

As shown in FIG. 4, the spring biasing force upon the arming slider 3 tends away from arming. This is done by pre-biasing the arming slider latch head 95 by drawing it leftwards (in FIG. 4) into the spring head socket 20 (FIG. 3A), where it latches. This is in contrast to U.S. Pat. No. 6,167,809, which shows a spring bias towards arming.

The present invention adds a zig-zag delay to the arming slider 3. The zig-zag delay increases the inherent safety of the S&A device by incorporating mechanical delay in the arming slider 3 actuation. This increased mechanical delay increases the minimum distance from the gun at which mechanical arming can occur. The zig-zag delay also renders the arming slider 3 axially immobile during setback or setforward acceleration inputs, because inertial loading across the slider's axis of action tends to engage the zig-zag features, which will prevent its axial motion.

The present invention introduces a sequential hook-and-catch engagement between the setback and arming sliders 5, 3. The setback slider 5 must be at least partially deflected downward in its track 85 due to the presence of some axial acceleration loading before the arming slider 3 can be free to move to the right. If the setback slider 5 is not first displaced downward, then motion of the arming slider 3 to the right will engage the hook-and-catch arrangement, preventing further motion of both sliders. But this happens only temporarily. Once a temporary lateral acceleration ceases, the arming slider 3 will be drawn left by its tensioning spring 9 to release the setback slider catch 58. The ability of the arming and setback sliders 3, 5 to reset to their starting and unactuated positions after brief inertial inputs is an important feature of the invention because it means that handling shocks such as a 5-ft or 40-ft drop will only partially and momentarily deflect the sliders. Thus, the sliders will reset to be ready for actual launch or another spurious input.

The setback lock lever tab 42 engagement with the arming slider setback lock catch 34 has a negative taper that tends to encourage locking when the arming slider 3 tries to deflect toward arming. This improves safety because an off-axis impact to the assembled device might deflect the setback slider 5 partially down its track 85 and at the same time exert a side load on the arming slider 3 in the arming direction, such that the arming slider 3 loads against the setback lock lever tab 42. It is implicit here that the interlock of setback slider interlock catch 58 and arming slider interlock hook 33 was missed due to motion of the setback slider 5. If the tab 42 to catch 34 engagement were "positively" tapered, the loading of the arming slider 3 against it might pop the lock tab 42 out of the engagement. As it is, however, as the arming slider 3 tries to move to the right while the setback lock lever tab 42 is still engaged, the negative taper tends to maintain, rather than release, the engagement.

In a case of malassembly wherein the setback slider 5 is left out of the assembly, the setback lock lever tab 42 will tend to stay engaged and force a fail-safe condition because: a) there will be no setback slider 5 to impact the setback lock lever tip 43, tear out the breakaway tab 44 and pull out the setback lock tab 42, and b) in the presence of a side load or spin-induced acceleration field the negative taper of the setback lock tab 42 engaging with the arming slider setback lock catch 34 will, as said before, tend to keep the lock engaged.

The present invention introduces a threshold breakaway feature in the form of a breakaway tab 44 on the setback slider lock lever 4 which prevents deflection of the setback lock lever 4, and hence prevents disengagement of the first arming slider lock, until the full weight and momentum of the moving setback slider 5 is thrown against the lever 4 by setback-induced forces. Under its own self-mass, the setback lock lever 4 will not breakaway the tab 44 for any inertial input to be encountered in the anticipated application. But under the inertial environment of launch setback, the setback slider 5 bearing down upon the setback lock lever tip 43 will rupture the breakaway tab 44.

Further improvements to the setback lock lever breakaway tab 44 are designed to provide strength in response to inertial inputs from normal handling loads, at the same time to cause it to rupture quickly and cleanly when impact from the setback slider 5 occurs during launch. This quick and clean rupture is achieved by simultaneously combining a tensile and a bending force to the neck 45 of the tab 44, as well as by designing the tab neck 45 with a narrower area for stress concentration where it meets the head 44.

The present invention introduces a wavy-spring design of the tensioning springs 7, 9 that increases spring compliance by increasing the length of spring for a given number of coils of given thickness at a given separation between coils, and improves the reliability of the fabrication process by providing a self-supporting geometry for the negative-block mold into which the spring material is typically plated.

The present invention introduces improvements in latch and socket designs based on further structural analysis and experimental demonstration. These improvements apply to both the spring tensioning latch heads 75, 95 and sockets 18, 20 and the slider latch heads 52, 36 and sockets 15, 25. Compared to U.S. Pat. No. 6,167,809, the present invention incorporates the latch barbs onto the slider and spring latch heads rather than trying to form the barbs as part of the frame 1. This is for a technical reason in fabrication, that is, if the barbs are part of the frame, to make them movable some etching has to occur to remove some of the bond layer between the frame and the substrate. To remove the bond layer under the barbs means the whole frame has to be exposed to the etchant, which can weaken its attachment to the substrate. Also, the barbs then will be the same thickness as the frame, so they will scrape against the cover plate.

The latch barbs of the present invention are also designed to be shorter and thicker, and, therefore, stiffer than the ones in the prior art, and they incorporate a slight bow to pre-dispose them to buckle in a favorable direction under load. The new latch barbs also require a greater deflection and insertion force to engage in the socket, increasing the functional robustness of the design. The latch heads are shorter to allow a space between the latch head and the end of the socket, for any debris or particles to collect there without obstructing the positive latching of the head.

The present invention utilizes a method of fabrication and assembly that involves creating assembly "frames" on substrate dies separate from the individually-inserted parts, and into which the individual parts are later placed and in which they are prepared for operation (e.g., by drawing a spring head into a pre-biasing socket). This is in contrast to the "in situ" method of assembly of U.S. Pat. No. 6,167,809, and it greatly increases the probable device yield ratio (parts formed correctly divided by parts attempted). The yield ratio increases because the process for forming the frames can be technically optimized, in terms of material choice, pattern and etch "recipe", and at the same time can be cost-optimized in terms of the potential for relaxed tolerances compared to the "parts", which may enable the use of printing-type replication methods instead of first-generation LIGA, etc. The process for forming the "parts" can be optimized, partly because they can be fabricated in a separate process from the frames, and partly because all parts of a given type or tolerance specification, e.g., all springs, can be fabricated in a specifically-optimized process for that part type. The process for springs can be optimized separately from the process for lock levers, for example. The probability of obtaining perfect assemblies is improved because each part can be computer-vision inspected before assembly, so that only good parts go into the finished product. The above advantages are in contrast to the difficulties of fabrication of the in-situ method, in which process parameters are an uneasy compromise between the requirements for realizing such diverse parts as springs and sliders in a simultaneous process, and the resulting parts cannot in general be removed and inspected.

The present invention implements a command lock rocker 6 which translates the output of a MEMS-fabricated piston-type actuator into the removal of the second-environment lock on the arming slider 3. The entire process is amenable to machine-vision inspection and micro-assembly, a rapidly-growing technology area with the potential for expedited manufacture and assembly and consequent large cost savings.

As compared to conventional mechanical S&A designs, as represented by U.S. Pat. Nos. 5,693,906 and 5,275,107; the present invention includes a smaller size (the present invention is realized in approximately one square centimeter of substrate area); improved safety logic (mechanical logic architecture); relative ease of manufacture and assembly through wafer-scale manufacture, integration, and assembly; no need for lubrication of parts; incorporation of a micro-scale firetrain.

The present invention, as a miniature electro-mechanical safety and arming device, offers many technical and economic advantages for a variety of applications. Some of the applications include mortars, artillery, tanks, small caliber guns, submunitions and grenades. Other applications include missiles, rocket-propelled grenades, shoulder-launched rockets, bombs and torpedos.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A safety and arming device, comprising:

a substrate;

a frame disposed on the substrate;

a setback slider disposed in the frame, the setback slider moving linearly in response to a setback acceleration; the setback slider including, on an end of the setback slider in a direction of the setback acceleration, a setback slider spring attached at one end to the setback slider and at another end to a setback slider latch head, the setback slider latch head for prebiasing the setback slider spring by inserting the setback slider latch head in a setback slider spring head socket in the frame; the setback slider further including, on an end of the setback slider in a direction opposite to the direction of the setback acceleration, a second setback slider latch head for locking the setback slider after linear movement of the setback slider by inserting the second setback slider latch head in a setback slider latch socket in the frame;

an arming slider disposed in the frame, the arming slider moving linearly in an arming direction perpendicular to the direction of the setback acceleration and in response to spin; the arming slider including, on an end of the arming slider in a direction opposite the arming direction, an arming slider spring attached at one end to the arming slider and at another end to an arming slider latch head for prebiasing the arming slider spring by inserting the arming slider latch head in an arming slider spring head socket in the frame; the arming slider further including, on an end of the arming slider in the arming direction, a second arming slider latch head for locking the arming slider after linear movement of the arming slider by inserting the second arming slider latch head in an arming slider latch socket in the frame;

a setback lock lever disposed in the frame, the setback lock lever engaging the arming slider to prevent linear motion of the arming slider until the setback slider contacts and moves the setback lock lever; and a command lock rocker disposed in the frame, the command lock rocker engaging the arming slider to prevent full arming motion of the arming slider until after the command lock rocker is actuated.

2. The device of claim 1 wherein the arming slider spring is formed integrally with the arming slider.

3. The device of claim 1 wherein the arming slider spring is connected to an insertion plug that is inserted in a socket in the arming slider.

4. The device of claim 1 wherein the setback slider spring is formed integrally with the setback slider.

5. The device of claim 1 wherein the setback slider spring is connected to an insertion plug that is inserted in a socket in the setback slider.

6. The device of claim 1 wherein the setback slider includes zig-zag racks that cooperate with zig-zag tracks in the frame to delay movement of the setback slider.

7. The device of claim 1 wherein the arming slider includes zig-zag racks that cooperate with zig-zag tracks in the frame to delay movement of the arming slider.

8. The device of claim 1 wherein the arming slider comprises an upper arm having an interlock hook at an end thereof, the setback slider comprising a right arm having a catch at an end thereof wherein in an initial position of the setback slider, the catch of the setback slider engages the interlock hook of the arming slider to prevent movement of the arming slider, if the arming slider begins moving to an arming position before the setback slider has at least partially moved in the direction opposite the setback acceleration.

9. The device of claim 1 wherein the setback lock lever comprises a setback lock lever tab, a setback lock lever breakaway tab head and a setback lock lever tip; the frame comprising a setback lock lever pin socket for receiving the setback lock lever breakaway tab head; the arming slider comprising an arming slider setback lock catch for receiving the setback lock lever tab, the setback lock lever tip protruding into a path of the setback slider wherein linear motion of the setback slider in the direction opposite the setback acceleration engages the setback slider with the setback lock lever tip, bend the setback lock lever, break the setback lock lever breakaway tab head and remove the setback lock lever tab from the arming slider setback lock catch to thereby free the arming slider for movement towards the armed position.

10. The device of claim 1 wherein the arming slider includes an arming slider command lock catch slot and the command lock rocker includes a command lock enable catch tab wherein the command lock enable catch tab is disposed in the arming slider command lock catch slot to prevent the arming slider from moving to the armed position.

11. The device of claim 10 wherein the command lock rocker includes an anchor section, a torsion bar section connected to the anchor section, a lower rocker arm connected to the torsion bar section and an inclined arm connected to the torsion bar section.

12. The device of claim 11 wherein the lower rocker arm includes the command lock enable catch tab, an anti-rotation guide tab and a tilt latch.

13. The device of claim 12 wherein the inclined arm includes a piston arm out of a plane of the frame and a rocker piston tab attached to the piston arm.

14. The device of claim 13 further comprising a cover plate assembly disposed over the frame, the cover plate assembly including a piston disposed adjacent the rocker piston tab.

15. The device of claim 14 wherein the piston, when actuated, is operable to move the rocker piston tab downwardly, thereby removing the command lock enable catch tab from the arming slider command lock catch slot and enabling the arming slider to move to the armed position.

16. The device of claim 14 wherein the arming slider includes an arming slider preventer tab disposed beneath the rocker piston tab that prevents the rocker piston tab from moving downwardly until the arming slider has moved a predetermined distance toward the armed position.

17. The device of claim 1 further comprising an arming detent assembly disposed in the frame adjacent the arming slider, the arming slider including detents; the arming detent assembly including a compression spring, a body connected to the compression spring and a slider pin connected to the body wherein the slider pin engages the detents in the arming slider to hold the arming slider in a fixed position.

18. The device of claim 1 wherein the setback slider latch head, the second setback slider latch head, the arming slider latch head and the second arming slider latch head each include latch barbs thereon.

19. The device of claim 18 wherein the latch barbs define stress relief radii at attachment points to respective latch heads.

20. The device of claim 1 wherein the setback slider spring head socket, setback slider latch socket, arming slider spring head socket and arming slider latch socket have lengths that are longer than respective lengths of the setback slider latch head, the second setback slider latch head, the arming slider latch head and the second arming slider latch head such that a clearance space remains between each latch head and socket when the latch head is fully latched.

21. The device of claim 14 wherein the arming slider includes a transfer pocket, the cover plate assembly includes an input column and the substrate includes an output column so that when the arming slider is in the armed position, the input column is adjacent one end of the transfer pocket and the output column is adjacent another end of the transfer pocket.

22. The device of claim 21 wherein the cover plate assembly further comprises a propellant charge disposed above the piston.

23. The device of claim 22 further comprising an explosive initiator assembly disposed above the cover plate assembly, the explosive initiator assembly including a firetrain thin film initiator disposed above the input column and a piston thin film initiator disposed above the propellant charge above the piston.

24. The device of claim 23 further comprising an electrical contact disposed above the explosive initiator assembly, the electrical contact being in electrical communication with the firetrain thin film initiator and the piston thin film initiator.

25. The device of claim 24 further comprising an explosive output assembly disposed below the substrate, the explosive output assembly including an output explosive charge disposed below the output column.

26. The device of claim 21 wherein the arming slider includes a transfer charge disposed in the transfer pocket.

27. A safety and arming device, comprising:

a substrate;

a frame disposed on the substrate;

a setback slider disposed in the frame, the setback slider moving linearly in response to a setback acceleration; the setback slider including, on an end of the setback slider in a direction of the setback acceleration, a setback slider spring attached at one end to the setback slider and at another end to a setback slider latch head, the setback slider latch head for prebiasing the setback slider spring by inserting the setback slider latch head in a setback slider spring head socket in the frame; the setback slider further including, on an end of the setback slider in a direction opposite to the direction of the setback acceleration, a second setback slider latch head for locking the setback slider after its linear movement by inserting the second setback slider latch head in a setback slider latch socket in the frame;

an arming slider disposed in the frame, the arming slider moving linearly in an arming direction perpendicular to the direction of the setback acceleration and in response to spin; the arming slider including, on an end of the arming slider in a direction opposite the arming direction, an arming slider spring attached at one end to the arming slider and at another end to an arming slider latch head for prebiasing the arming slider spring by inserting the arming slider latch head in an arming slider spring head socket in the frame;

a setback lock lever disposed in the frame, the setback lock lever engaging the arming slider to prevent linear motion of the arming slider until the setback slider contacts and moves the setback lock lever; and a command lock rocker disposed in the frame, the command lock rocker engaging the arming slider to prevent full arming motion of the arming slider until after the command lock rocker is actuated.

28. A safety and arming device, comprising:

a substrate;

a frame disposed on the substrate;

a setback slider disposed in the frame, the setback slider moving linearly in response to a setback acceleration; the setback slider including, on an end of the setback slider in a direction of the setback acceleration, a setback slider spring attached at one end to the setback slider and at another end to a setback slider latch head, the setback slider latch head for prebiasing the setback slider spring by inserting the setback slider latch head in a setback slider spring head socket in the frame; the setback slider further including, on an end of the setback slider in a direction opposite to the direction of the setback acceleration, a second setback slider latch head for locking the setback slider after its linear movement by inserting the second setback slider latch head in a setback slider latch socket in the frame;

an arming slider disposed in the frame, the arming slider moving linearly in an arming direction perpendicular to the direction of the setback acceleration; the arming slider including, on an end of the arming slider in an arming direction, an arming slider spring attached at one end to the arming slider and at another end to an arming slider latch head for prebiasing the arming slider spring by inserting the arming slider latch head in an arming slider spring head socket in the frame;

a setback lock lever disposed in the frame, the setback lock lever engaging the arming slider to prevent linear motion of the arming slider until the setback slider contacts and moves the setback lock lever; and a command lock rocker disposed in the frame, the command lock rocker engaging the arming slider to prevent full arming motion of the arming slider until after the command lock rocker is actuated.

29. The device of claim 28 wherein the arming slider includes a lower arm extending in the arming direction, the lower arm having on an end thereof a second arming slider latch head for locking the arming slider after its linear movement to the armed position by inserting the second arming slider latch head in an arming slider latch socket in the frame.

30. The device of claim 8 further comprising a cover plate assembly disposed above the frame and an explosive initiator assembly disposed above the cover plate assembly wherein the explosive initiator assembly and the cover plate assembly include a safe inspection hole and an armed inspection hole, the safe inspection hole being located above the initial position of the arming slider interlock hook and setback slider interlock catch, and the armed inspection hole being located above the arming slider latch socket.

31. The device of claim 21 further comprising an inductive coupler assembly disposed in the transfer pocket wherein the input column comprises an input coil assembly and the output column comprises a receptor coil.

32. The device of claim 31 wherein the inductive coupler assembly comprises a receiving coil electrically connected to an emitter coil.

33. The device of claim 21 further comprising an optical coupler disposed in the transfer pocket wherein the input column comprises an input light source and the output column comprises an optical sensor.

34. A safety and arming device, comprising:

a substrate;

a frame disposed on the substrate;

a setback slider disposed in the frame, the setback slider moving linearly in response to a setback acceleration; the setback slider including, on an end of the setback slider in a direction of the setback acceleration, a setback slider spring attached at one end to the setback slider and at another end to a setback slider latch head, the setback slider latch head for prebiasing the setback slider spring by inserting the setback slider latch head in a setback slider spring head socket in the frame; the setback slider further including, on an end of the setback slider in a direction opposite to the direction of the setback acceleration, a second setback slider latch head for locking the setback slider after its linear movement by inserting the second setback slider latch head in a setback slider latch socket in the frame;

an arming slider disposed in the frame, the arming slider moving linearly in an arming direction perpendicular to the direction of the setback acceleration and in response to spin; the arming slider including, on an end of the arming slider in a direction opposite the arming direction, an arming slider spring attached at one end to the arming slider and at another end to an arming slider latch head for prebiasing the arming slider spring by inserting the arming slider latch head in an arming slider spring head socket in the frame; the arming slider further including on an end of the arming slider in the arming direction, a second arming slider latch head for locking the arming slider after its linear movement by inserting the second arming slider latch head in an arming slider latch socket in the frame;

a setback lock lever attached to a lower arm of the arming slider, the setback lock lever engaging the frame to prevent linear motion of the arming slider until the setback slider contacts and moves the setback lock lever; and a command lock rocker disposed in the frame, the command lock rocker engaging the arming slider to prevent full arming motion of the arming slider until after the command lock rocker is actuated.

* * * * *